United States Patent [19]

Mukunoki et al.

[11] Patent Number: 5,028,516

[45] Date of Patent: Jul. 2, 1991

[54] METHOD OF FORMING AN IMAGE COMPRISING RAPIDLY DEVELOPING AN INFRARED SENSITIZED PHOTOGRAPHIC MATERIAL COMPRISING SURFACTANTS

[75] Inventors: Yasuo Mukunoki; Naoki Arai; Kazuo Kagawa, all of Kanagawa, Japan

[73] Assignee: Fuji Photo Film Co., Ltd., Kanagawa, Japan

[21] Appl. No.: 338,343

[22] Filed: Mar. 27, 1989

Related U.S. Application Data

[63] Continuation of Ser. No. 129,105, Dec. 4, 1987, abandoned.

[30] Foreign Application Priority Data

| | | | |
|---|---|---|---|
| Dec. 4, 1986 | [JP] | Japan | 61-289702 |
| Dec. 12, 1986 | [JP] | Japan | 61-295881 |
| Dec. 12, 1986 | [JP] | Japan | 61-295883 |

[51] Int. Cl.[5] ..... G03C 1/82; G03C 1/38

[52] U.S. Cl. ..... 430/403; 430/434; 430/527; 430/529; 430/631; 430/944; 430/945; 430/963

[58] Field of Search ..... 430/434, 403, 527, 631, 430/944, 945, 963, 529

[56] References Cited

U.S. PATENT DOCUMENTS

| | | | |
|---|---|---|---|
| 4,029,510 | 6/1977 | Speers | 430/963 |
| 4,030,924 | 6/1977 | Hofman | 430/963 |
| 4,367,283 | 1/1983 | Nakayama et al. | 430/631 |
| 4,396,706 | 8/1983 | Ishii et al. | 430/434 |
| 4,649,102 | 3/1987 | Mukunoki et al. | 430/631 |
| 4,711,838 | 12/1987 | Grzeskowiak et al. | 430/944 |
| 4,794,070 | 12/1988 | Philip, Jr. et al. | 430/944 |

FOREIGN PATENT DOCUMENTS

| | | | |
|---|---|---|---|
| 49021 | 4/1977 | Japan | 430/527 |
| 249047 | 11/1986 | Japan | 430/527 |

OTHER PUBLICATIONS

RD 17643, Dec. 1978, pp. 26–28.

*Primary Examiner*—Charles L. Bowers, Jr.
*Assistant Examiner*—Patrick Doody
*Attorney, Agent, or Firm*—Sughrue, Mion, Zinn, Macpeak & Seas

[57] ABSTRACT

A method of forming an image comprising exposing, developing and fixing a laser scanner-utilizable silver halide photographic material which has at least one silver halide emulsion layer sensitized spectrally in an infrared region on one side of a support, said silver halide photographic material containing in at least one layer located on the emulsion layer side one or more of an additive selected from among:

(1) surface active agents having a solubility of 0.005 wt % or more at 30° C. in a developer and a surface tension of 45 dyne/cm or less (measured at 30° C. in a condition of 1.0 wt % aqueous solution), and (2) polymers represented by the following general formula (I), and having a molecular weight of from 2,000 to 500,000:

$$(X)_x(Y)_y \qquad (I)$$

wherein X represents a residue of an acrylamide monomer, and Y represents a residue of a monomer other than X, which can undergo copolymerization with X, and these monomers each may be a mixture of two or more thereof; x represents a fraction of 70 to 100 mol %, and y represents a fraction of 30 to 0 mol %, and wherein development processing is completed within 15 seconds.

15 Claims, No Drawings

METHOD OF FORMING AN IMAGE COMPRISING RAPIDLY DEVELOPING AN INFRARED SENSITIZED PHOTOGRAPHIC MATERIAL COMPRISING SURFACTANTS

This is a Continuation of application Ser. No. 07/129,105, filed 12/4/87 now abandoned.

FIELD OF THE INVENTION

The present invention relates to a method of forming an image using a laser scanner-utilizable silver halide photographic material having spectral sensitivity in the infrared region (which is abbreviated as a photographic material, hereinafter), and improved in antistaticity and facility in travel in the form of film without being attended by deterioration of photographic characteristics and, more particularly, to an image-forming method which does not cause development mark even when a development processing is performed in a short time (or within 15 seconds).

BACKGROUND OF THE INVENTION

As one of exposure techniques for photographic light-sensitive materials, there is known a so-called scanner technique in which an original is scanned, and a silver halide photographic material is subjected to exposure based on resultant image signals to form a negative or positive image corresponding to the original image. The image-forming method utilizing the scanner technique is embodied in various recording apparatuses, and a semiconductor laser is employed as one of recording light sources for these scanner type recording apparatuses.

A semiconductor laser is small in size and available at a low price, and has facility in modulation and a long life. In addition, it has a further advantage that it may be worked with under a bright safelight because it emits a ray in the infrared region, resulting in improved facility for handling a photographic material.

A sensitive material to be used for such a semi-conductor laser is a photographic light-sensitive material having spectral sensitivity in the infrared region, and it can be obtained utilizing a spectral sensitization technique which consists of extending sensitivity toward a longer wavelength region by addition of a cyanine dye to silver halide photographic emulsions. Spectral sensitization for extension of sensitivity toward the infrared region is effected by using sensitizing dyes capable of absorbing light in the infrared region.

In recent years, as the scanning speed of a semiconductor scanner has been increased, a need for reduction of development processing time (within 15 seconds) has been felt.

However, with all conventional techniques, it frequently happens that a developer remains nonuniformly on a sensitive material when the sensitive material is squeezed out of a developing bath and transferred into a fixing bath in the course of the photographic processing, causing nonuniformity in the image which is called "development mark". This remains a grave problem.

As development time is shortened, it becomes necessary to accelerate the conveyance of the photographic light-sensitive material, as a result of which nonuniformity of development is more likely, and the occurrence of "development marks" increases.

Furthermore, conventional infrared-sensitive silver halide photographic materials used for the image formation utilizing semiconductor laser as a light source have a problem that they are insufficient in antistatic capacity and facility in travel of films.

Since a photographic material is generally constructed from electrically nonconductive support and photographic layers, it frequently happens during the production and upon the use thereof that electrostatic charges are accumulated by contact friction between surfaces of the same kind or different kinds of substances or by separation of superposed layers of substances of the same kind or different kinds through peeling. These accumulations of electrostatic charge cause many problems. More specifically, one serious problem consists in that light-sensitive emulsion layers are sensitive to the discharge of electrostatic charges discharged thereon before development processing to result in generation of dot-like spots, or branch-like or feather-like streaks on the developed photographic image. Further, secondary problems, such that a film surface on which electrostatic charges are accumulated is subject to adhesion of dust, causes poor condition of travel upon photographing and conveyance with a film-conveying device, make it impossible to effect uniform coating, and so on.

In the scanner method utilizing a semiconductor laser, it is essential to convey films at high speed and with exactness. As the film is conveyed at high speed, static electricity may develop, interfering with the smooth conveyance of the film, as a result of which it becomes impossible to obtain accurate images.

A problem similar to that described above is caused at the time of film conveyance (particularly before the dip in a developing bath) in an automatic developing machine designed so as to perform rapid processing.

One method for overcoming problems arising from static electricity consists in designing a photosensitive material with increase in electric conductivity of surfaces of the photosensitive material so that accumulated electrostatic charges may be dispersed and lost before discharge.

To this end, a wide variety of methods for increasing conductivities of a support and various sorts of layers coated at the surface of a photosensitive material have so far been thought out, and various hygroscopic substances and water-soluble inorganic salts, certain kinds of surface active agents, polymers and so on have been experimented with in order to improve conductivity.

For instance, it has been determined that photographic light-sensitive materials with excellent antistatic capacity and facility in smooth travel can be obtained by adding nonionic surface active agents to surface protecting layers.

In recent years, as discussed above, a development processing time (which has so far been above 20 seconds) has come to be in need of reduction. The soonest possible visualization of images has been keenly desired in the semiconductor laser-utilizing scanner method.

In particular, a great need has arisen for a system designed so as to perform the laser scanning and the development processing steps successively.

However, reduction of development processing time to a period not exceeding 15 seconds through addition of nonionic surface active agents as described above has turned out to be accompanied with a serious problem that nonuniformity of image quality, called "development mark", was caused. The development mark was thought to be ascribed to nonuniform progress of development corresponding to nonuniform distribution of a developer remaining on the surface of a photosensitive material after being squeezed out of a developing bath and transferred into a fixing bath, which is due to sporadic separation of developer from surface or separation of agent at the surface of the photosensitive material because of its very low solubility in the developer.

More specifically, the development caused by the developer remaining nonuniformly on the surface of the photosensitive material after the step of squeezing out the developer cannot be disregarded because as the developing speed is increased in order to shorten the development time, the occurrence of development marks is also increased.

SUMMARY OF THE INVENTION

Therefore, a first object of the present invention is to provide a method of forming an image by developing and fixing a laser scanner-utilizable photographic light-sensitive material which is not only sensitized spectrally in the infrared region, but also rendered antistatic so that generation of static electricity upon contact with various materials may be suppressed.

A second object of the present invention is to provide a method of forming an image by developing and fixing a laser scanner-utilizable photographic light-sensitive material sensitized spectrally in the infrared region, which does not exhibit development marks even when a development time not exceeding 15 seconds is employed.

A third object of the present invention is to provide a method of forming an image in a short time by developing and fixing a laser scanner-utilizable photosensitive material which has high sensitivity.

A fourth object of the present invention is to provide a method of forming an image using a laser scanner-utilizable light-sensitive material which does not cause adhesion to another light-sensitive material superposed thereon even when they are preserved for a long time.

A fifth object of the present invention is to provide a method of forming an image using a laser scanner-utilizable photographic light-sensitive material which is not accompanied by coating troubles such as generation of cissing blisters, etc.

These and other objects are attained according to the present invention by a method of forming an image by developing and fixing a laser scanner-utilizable silver halide photographic material which has at least one silver halide emulsion layer sensitized spectrally in an infrared region on one side of a support, the silver halide photographic material containing in at least one layer located on the emulsion layer side one or more additives selected from among: (1) polymers represented by the following general formula (I) and having a molecular weight of from 2,000 to 500,000:

$$-(X)_x(Y)_y- \quad (I)$$

wherein X represents a residue of an acrylamide monomer, and Y represents a residue of a monomer other than X, which can undergo copolymerization with X, and X or Y may each be a mixture of two or more monomers; x represents a fraction of 70 to 100 mol %, and y represents a fraction of 30 to 0 mol %, and (2) surface active agents having a solubility of 0.005 wt % or more (at 30° C.) in a developer and a surface tension of 45 dyne/cm or less (measured at 30° C. in a condition of 1.0 wt % aqueous solution) and being development processed within 15 seconds.

DETAILED DESCRIPTION OF THE INVENTION

A silver halide photographic emulsion sensitized spectrally in the infrared region, which can be used in the present invention, can be obtained by adding a sensitizing dye of the kind which absorbs light in the infrared region to silver halide emulsion grains.

Sensitizing dyes having light absorption in the infrared region are described below.

They are described, for instance, in C.E.K. Mees, *The Theory of the Photographic Process, 3rd* Ed., pp. 198–201, Macmillan Publishing Co., Inc. (1966). For the purpose of effectively achieving spectral sensitization, it is to be desired that sensitizing dyes should have high spectral sensitivity, that is, high sensitivity to infrared rays, and little change in spectral sensitivity during storage. With the intention of answering these requirements, a number of sensitizing dyes have so far been developed. As examples of compounds capable of effecting infrared sensitization, mention may be made of triazine derivatives as described in U.S. Pat. Nos. 2,095,854, 2,095,856, 2,955,939, 3,482,978, 3,552,974, 3,573,921 and 3,582,344, and further U.S. Pat. Nos. 2,875,058 and 3,695,888; mercapto compounds as described in U.S. Pat. No. 3,457,078; thiourea compounds as described in U.S. Pat. No. 3,458,318; pyrimidine compounds as described in U.S. Pat. No. 3,615,632; and combinations of desensitizing amounts of infrared sensitizing dyes with azaindene compounds as described in U.S. Pat. No. 4,011,083.

As another suitable example, there can be cited tricarbocyanine dyes and/or 4-quinoline nucleus-containing dicarbocyanine dyes described in Japanese Patent Application (OPI) No. 80841/85 (the term "OPI" as used herein refers to a "published unexamined Japanese patent application").

Typical examples of effective infrared sensitizing dyes are illustrated below. However, the invention should not be construed as being limited to these examples.

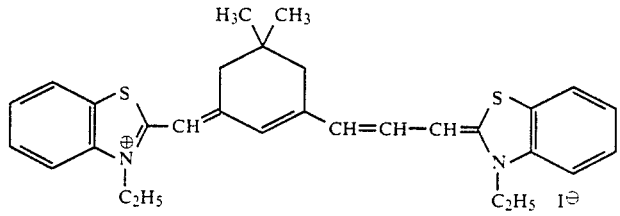

-continued
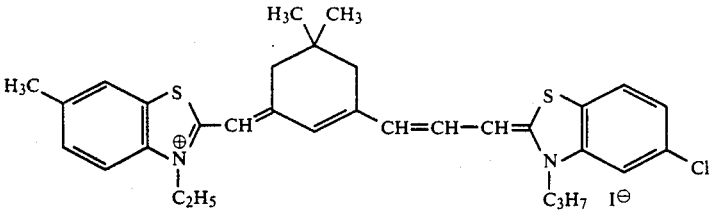
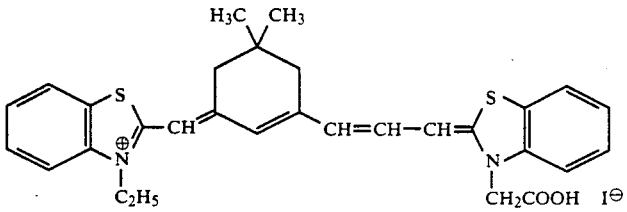
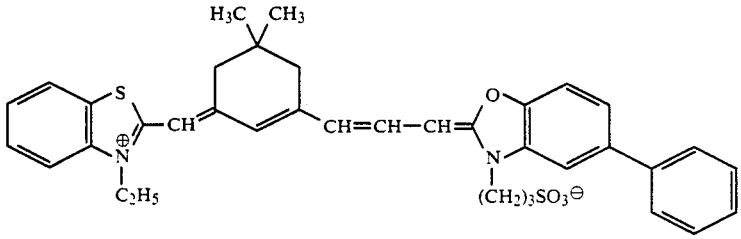
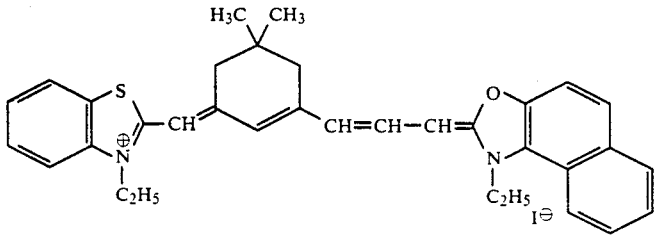
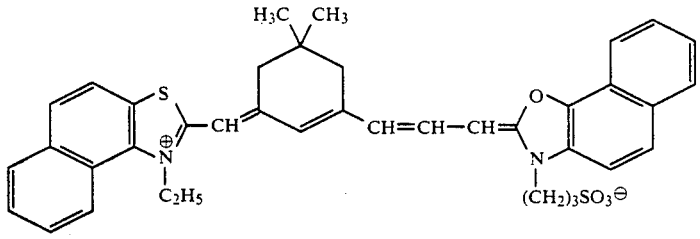
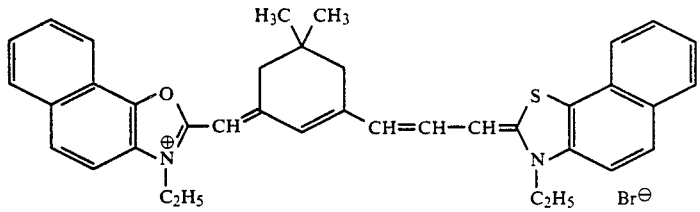
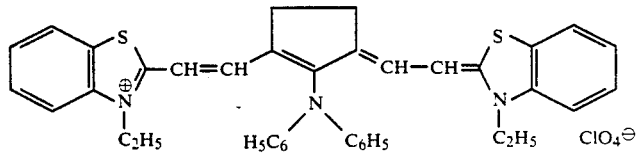

-continued
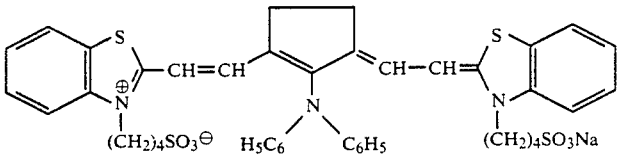
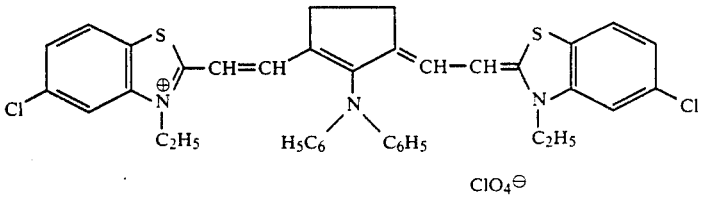
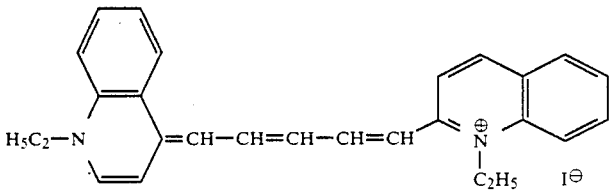
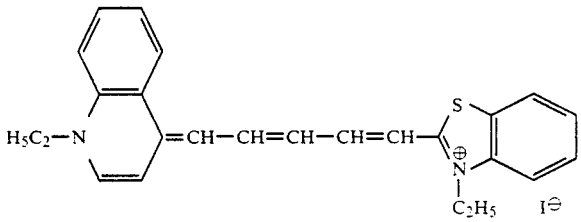
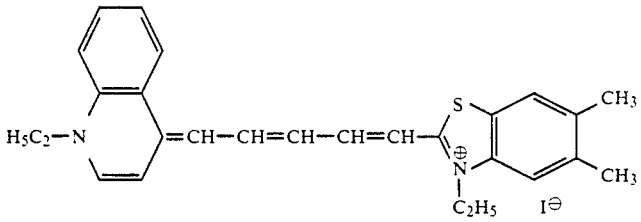
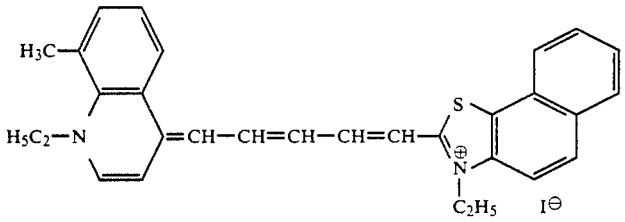
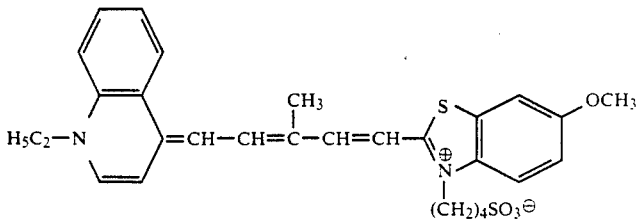

-continued

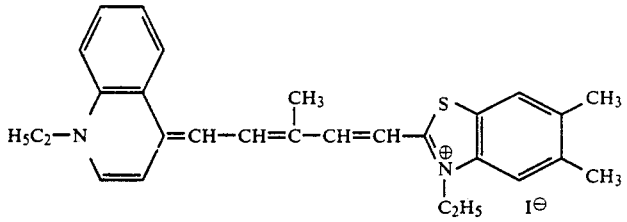

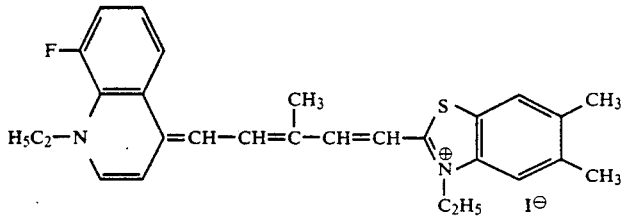

These sensitizing dyes are each added in an amount of from $5\times10^{-7}$ to $5\times10^{-3}$ mol, preferably from $1\times10^{-6}$ to $1\times10^{-3}$ mol, and particularly preferably from $2\times10^{-6}$ to $5\times10^{-4}$ mol, per mol of silver halide.

Silver halide grains which can be used in the present invention may be constituted from any of the halides including chloride, bromide and iodide. That is, silver chloride, silver bromide, silver iodobromide, silver chlorobromide, silver chloroiodide, silver chloroiodobromide and so on can be used. However, silver bromide, silver iodobromide and silver chloroiodobromide are particularly preferred in the present invention. Therein, the iodide content is preferably controlled to 0 to 20 mol %, particularly 0 to 10 mol %, and the chloride content is preferably controlled to 20 mol % or less, particularly 10 mol % or less, and more particularly 5 mol % or less.

Silver halide grains used particularly preferably in the present invention have (100) and (111) faces in a (100)/(111) ratio of 1 or above, and can be prepared by various processes. The most generally employed process comprises adding simultaneously an aqueous solution of silver nitrate and an aqueous solution of alkali halide as the pAg during grain formation is kept at a constant value below 8.10 (a so-called controlled double jet process). Therein, the pAg to be kept constant is preferably 7.80 or less, and more preferably 7.60 or less. When the formation of silver halide grains is divided into two stages of formation of seed crystals and crystal growth, the pAg in the former stage has no particular restriction, and that in the latter stage has the above-mentioned restriction.

These emulsion grains may be coarse or fine, or a mixture thereof. However, it is desirable for them to have a mean grain size of about 0.04 micron to 1.0 micron when measured on the basis of a projected area method or a number average method. As for the size distribution, a monodispersed emulsion having a coefficient of variation not exceeding 20%, preferably 15%, is employed to advantage.

The grains, though preferably in the form of a cube, may have any irregular form, e.g., a form like a potato, a spherical form, a plate form, a tabular form having a grain diameter greater than a grain thickness by a factor of 5 or more, or so on, provided that they satisfy the above-described requirement for the indices of planes.

In the light-sensitive material to be used in the present invention, not only one but also two or more silver halide emulsion layers may be provided, or not less than two kinds of emulsions differing in grain size, sensitivity or so on may be coated as a mixture in a single layer, or independently in separate layers. Also, emulsion layers may be provided on not only one side of a support but also on both sides thereof.

A light-sensitive emulsion as described above and a substantially light-insensitive emulsion (e.g., an internally fogged fine grain emulsion) may be used as a mixture. Of course, these emulsions may be coated in separate layers.

As for the crystal structure, the silver halide grains may be uniform throughout, or may have such a layer structure that the interior and the surface differ, or a so-called conversion type structure as described in British Patent 635,841 and U.S. Pat. No. 3,622,318. Further, either silver halide grains of the kind which form latent image predominantly at the surface of the grains, or grains of the kind which mainly form latent image inside the grains can be used.

It is preferable to use iridium ion in the emulsion of the present invention. Incorporation of iridium ion into the emulsion can be achieved by addition of a water-soluble iridium compound (e.g., hexachloroiridate(III), hexachloroiridate(IV), etc.) in the form of water solution in a process of preparing the emulsion. More specifically, the iridium compound may be added in the form of a water solution having the same components for forming silver halide grains, or the addition may be carried out before grain formation, during grain formation, or within a period from the conclusion of grain formation to the beginning of chemical sensitization. In particular, the addition at the time of grain formation is preferred.

At the time of forming silver halide grains, a silver halide solvent, such as ammonia, potassium thiocyanate, ammonium thiocyanate, thioether compounds, thione compounds, amine compounds, or so on, can be used in order to control the grain growth.

In addition to the silver halide solvent, a compound capable of controlling the crystal habit through the adsorption to the grain surface, e.g., a cyanine type sensitizing dye, a tetraazaindene compound, a mercapto compound, or so on, can be used at the time of grain formation.

To the silver halide photographic emulsions, conventional chemical sensitization processes, e.g., gold sensitization, sulfur sensitization, reduction sensitization, sensitization by a thioether compound, and other various processes can be applied.

The above-described objects of the present invention are also attained by using a polymer represented by the following general formula (I) alone or in combination with the surface active agent in a proportion of 4 to 300 wt % to a binder to constitute the outermost layer:

$$\text{-}(X)_x(Y)_y\text{-} \quad \text{(I)}$$

wherein X represents an acrylamide residue; Y represents a monomer other than X, which can undergo copolymerization with X, or X or Y may be a mixture of two or more monomers; x represents 70 to 100 mol % and y represents 30 to 0 mol %; and which has a molecular weight ranging from 2,000 to 500,000.

Suitable examples of X to constitute the polymers of the general formula (I) which can be preferably used in the present invention include acrylamide, methacrylamide, N-alkylacrylamides (the alkyl moiety of which is, e.g., methyl, ethyl, hydroxyethyl, etc.), and N-alkylmethacrylamides (the alkyl moiety of which is the same as described above). Preferred examples of Y include vinyl alcohol, acrylic acid, methacrylic acid, maleic acid, itaconic acid, maleic anhydride, carboxystyrene, sulfostyrene, vinylsulfonic acid, $-CONHC(CH_3)_2CH_2SO_3H$ and salts thereof (e.g., alkali metal salts, ammonium salt, lower alkylamine salts, etc.), vinylpyrrolidone, vinyloxazolidine, acrylic acid esters (e.g., methyl acrylate, ethyl acrylate, hydroxyethyl acrylate, etc.), methacrylic acid esters (e.g., methyl methacrylate, ethyl methacrylate, hydroxyethyl methacrylate, etc.), itaconic acid esters (e.g., methyl itaconate, ethyl itaconate, hydroxyethyl itaconate, etc.), styrene, maleic acid esters (e.g., monomethyl maleate, dimethyl maleate, monoethyl maleate, diethyl maleate, monohydroxyethyl maleate, etc.), acrylonitrile, methacrylonitrile, and so on.

Specific examples of polymers which are used particularly preferably among those described above are illustrated below.

Compound Examples

I-1 $\text{-}(CH_2-\underset{\underset{CONH_2}{|}}{CH})_n\text{-}$ (mean molecular weight: 8,000)

I-2 $\text{-}(CH_2-\underset{\underset{CONH_2}{|}}{CH})_n\text{-}$ (mean molecular weight: 45,000)

I-3 $\text{-}(CH_2-\underset{\underset{CONH_2}{|}}{CH})_n\text{-}$ (mean molecular weight: 100,000)

I-4 $\text{-}(CH_2-\underset{\underset{CONHCH_3}{|}}{CH})_n\text{-}$ (mean molecular weight: 25,000)

I-5 $\text{-}(CH_2-\underset{\underset{CONH_2}{|}}{CH})_{98}(CH_2-\underset{\underset{COOH}{|}}{CH})_2\text{-}$ (mean molecular weight: 45,000)

I-6 $\text{-}(CH_2-\underset{\underset{CONH_2}{|}}{CH})_{90}(CH_2-\underset{\underset{COONa}{|}}{\overset{\overset{CH_3}{|}}{C}})_{10}\text{-}$ (mean molecular weight: 43,000)

-continued

Compound Examples

I-7 $\text{-}(CH_2-\underset{\underset{CONH_2}{|}}{CH})_{96}(CH_2-\underset{\underset{COOC_2H_5}{|}}{CH})_4\text{-}$ (mean molecular weight: 30,000)

I-8 $\text{-}(CH_2-\underset{\underset{CONH_2}{|}}{CH})_{75}(CH_2-\underset{\underset{COOCH_2CH_2OH}{|}}{CH})_{25}\text{-}$ (mean molecular weight: 16,000)

I-9 $\text{-}(CH_2-\underset{\underset{CONH_2}{|}}{CH})_{85}(CH_2-\underset{\underset{N}{|}}{CH})_{15}\text{-}$ (mean molecular weight: 80,000)

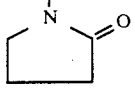

I-10 $\text{-}(CH_2-\underset{\underset{CONH_2}{|}}{CH})_{95}(CH_2-CH)_5\text{-}$ (mean molecular weight: 21,000)

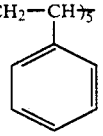

I-11 $\text{-}(CH_2-\underset{\underset{CONH_2}{|}}{CH})_{96}(CH_2-CH)_4\text{-}$ (mean molecular weight: 64,000)

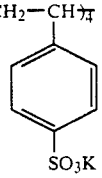

I-12 $\text{-}(CH_2-\underset{\underset{CONH_2}{|}}{CH})_{90}(CH_2-\underset{\underset{CONH\,CH_3}{|}}{CH})_{10}\text{-}$ (mean molecular weight: 45,000)

I-13 $\text{-}(CH_2-\underset{\underset{CONH_2}{|}}{CH})_{95}(CH_2-\underset{\underset{SO_3Na}{|}}{CH})_5\text{-}$ (mean molecular weight: 62,000)

I-14 $\text{-}(CH_2-\underset{\underset{CONH_2}{|}}{CH})_{90}(CH_2-\underset{\underset{OCOCH_3}{|}}{CH})_{10}\text{-}$ (mean molecular weight: 21,000)

The polymers of the present invention are those having a molecular weight of from 2,000 to 500,000, preferably from 2,000 to 150,000, and particularly preferably from 4,000 to 100,000.

It is desired that the polymers represented by the general formula (I) should be soluble in water, especially have a solubility of 0.1 wt % or above, preferably 1.0 wt % or above, in 25° C. water.

The polymer of the present invention is added to the outermost layer located on the emulsion layer side in a proportion of from 4 to 300 wt %, preferably from 4 to 200 wt %, and particularly preferably from 7.5 to 150 wt %, to the whole binders contained in the outermost layer. When the polymer of the present invention is added in an amount less or more than the above-described range, the desired effect upon prevention of development mark cannot be achieved, or no film can be formed by such a small amount of binder.

The polymer may be used together with a following surface active agent to achieve the advantages according to the present invention.

Images may be obtained with a high photographic speed (development time not exceeding 15 seconds)

without decrease in antistatic capacity, and without generation of development marks when the polymers of the present invention are incorporated into the outermost layer located on the emulsion layer side. In particular, the problem of development mark is solved as the result of success in making the developer, which remains on the surface of the sensitive material upon transfer from the developing bath to the fixing bath, spread uniformly by the incorporation of the polymer of the present invention.

The place to add the present polymer represented by the general formula (I) is the outermost layer located on the side of emulsion layers constituting the photographic material. Besides the addition to the outermost layer, the polymer of the present invention can bring about a more desirable effect by further addition to an emulsion layer and an interlayer provided on the emulsion layer side.

A surface active agent to be used in the present invention, which has a solubility of 0.005 wt % or more in a developer at 30° C. and a surface tension of 45 dyne/cm or less when measured in the form of a 1.0 wt % water solution, is described below.

As for the solubility, 0.01 wt % or more is preferable, and 0.20 wt % or more is more preferable.

As the for surface tension, the range of 40 to 10 dyne/cm is preferable, and the range of 35 to 10 dyne/cm is more preferable.

When a surface active agent having a solubility in a developer at 30° C. less than 0.005 wt % is employed, the surface of the light-sensitive material is stained with the surface active agent oozing out as an oily matter, and thereby a problem occurs in that the wettability of the sensitive material surface by a developer upon rapid processing is deteriorated. On the other hand, surface active agents whose surface tension is greater than 45 dyne/cm do not have a surface activation function sufficient for wetting uniformly the sensitive material surface upon rapid processing.

The surface active agents of the present invention are those containing a hydrophobic group such as a substituted or unsubstituted alkyl, alkenyl, aralkyl or aryl group having not less than 4 carbon atoms, and a hydrophilic group such as an anion, a cation, a betaine or a nionic group.

Preferred hydrophobic groups are substituted and unsubstituted alkyl, alkenyl, aralkyl and aryl groups containing 6 to 40 carbon atoms, with specific examples, including hexyl, octyl, nonyl, decyl, dodecyl, cetyl, stearyl, oleyl, nonylphenyl, octylphenyl, di-t-amylphenyl, dinonylphenyl, dodecylphenyl dodecylbiphenyl, bis(di-t-butylphenyl)methylene, bis(di-t-butylphenyl)-phenylmethylene, perfluorooctyl, perfluorodecyl, perfluorohexyl, perfluorononyl, perfluorododecyl and like groups.

As for the hydrophilic group, suitable examples of anionic groups include carboxylates, sulfonates, phosphates, sulfates and borates; those of cationic groups include tertiary amines, quaternary amines, phosphonium and sulfonium; those of betaine groups include amino acids, carboxy betaines, sulfoxy betaines and phospho betaines; and those of nonionic groups include polyoxyalkylenes, hydroxy, sorbitan, sugar and polyhydric alcohols. Of these hydrophilic groups, carboxylates, sulfonates, phosphates, sulfates, tertiary or quaternary amines, carboxy betaines, sulfo betaines, polyoxyalkylenes (alkylene moiety of which contains preferably 1 to 6 carbon atoms, with specific examples including ethylene, propylene, hydroxypropylene, etc.), hydroxy, sorbitan, and polyhydric alcohols are particularly preferred. As preferable examples of basic moieties to form salts together with acid moieties in the anionic groups cited above, mention may be made of hydrogen, alkali metals, alkaline earth metals, ammonium and lower amines. In the case where the hydrophilic group is an anion, a cation or a betaine, it is desired that the surface active agent should additionally contain a polyoxyalkylene moiety (the alkylene of which contains 1 to 6 carbon atoms).

Specific examples of these surface active agents are illustrated below.

II-1

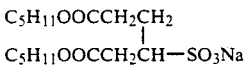

II-2

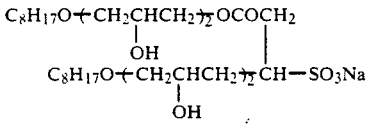

II-3

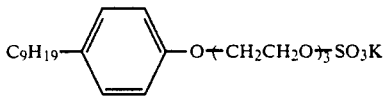

II-4

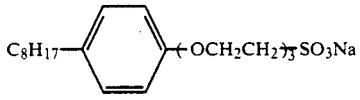

II-5

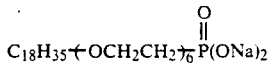

II-6

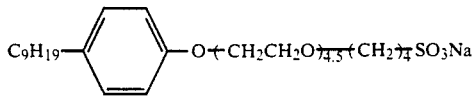

-continued
$C_{12}H_{25}O(CH_2CH_2O)_{15}CH_2COOK$ II-7
$C_{12}H_{25}-\oplus N(CH_2CH_2OH)_3Cl^{\ominus}$ II-8
$C_{16}H_{33}(O-CH_2CH_2)_{15}\oplus N(CH_2CH_2OH)_3Br^{\ominus}$ II-9
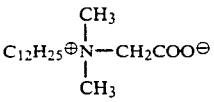
II-10
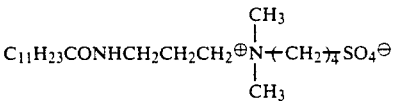
II-11
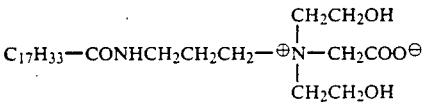
II-12
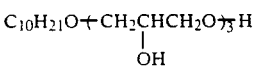
II-13
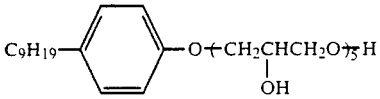
II-14
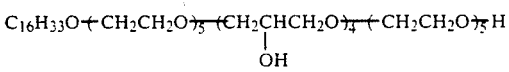
II-15
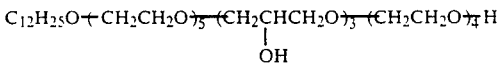
II-16
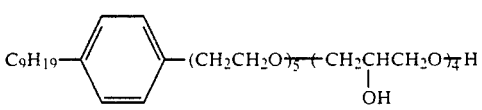
II-17
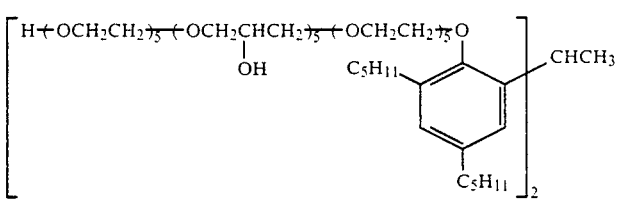
II-18
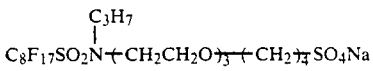
II-19
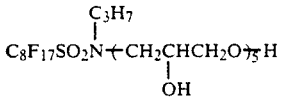
II-20
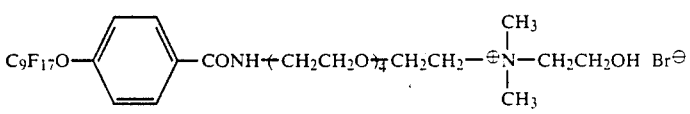
II-22
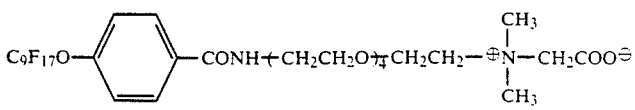
II-23

-continued

II-24

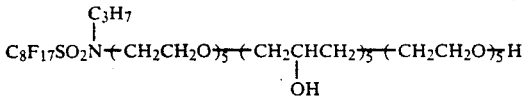

II-21

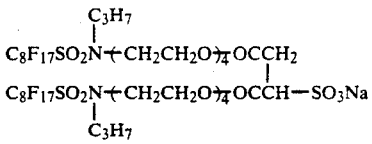

II-25

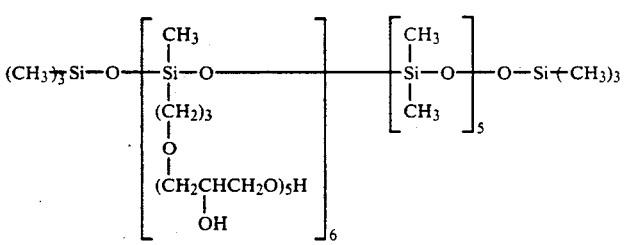

In particular, development mark generated is reduced to a marked extent even when a development time not exceeding 15 seconds (the term development time as used herein means the time from introduction of the photographic material into a developer until introduction thereof into a fixer) is employed.

In order to further render excellent properties to the photosensitive material of the present invention, nonionic surface active agents are effective to achieve the production of images with excellent quality without attendant deterioration of antistatic property and facility in film-traveling by a mechanical device even when a development time not exceeding 15 seconds is employed.

Examples of nonionic surface active agents which can be employed in the present invention are compounds containing an alkyl group, an alkenyl group, an aryl group and an aralkyl group having 4 to 30 carbon atoms as an oleophilic group, and a substituted or unsubstituted polyoxyalkylene group having 2 to 6 carbon atoms as a hydrophilic group. Particularly, the compounds of the general formulae (IV-A), (IV-B) or (IV-C) may preferably be illustrated as set forth below.

$$R_1-A\text{-}(B)_{n1}R \qquad \text{(III-A)}$$

(III-B)

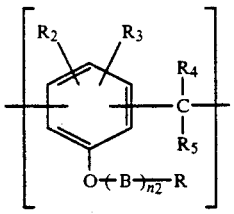

(III-C)

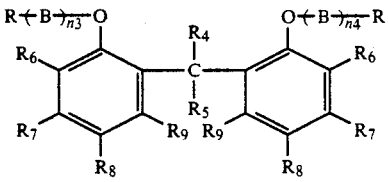

wherein R represents a hydrogen atom, an alkyl group having 1 to 4 carbon atoms, such as a methyl, ethyl, hydroxyethyl group, etc., or an alkylcarbonyl group having 1 to 5 carbon atoms such as an acetyl, chloroacetyl, carboxymethylcarbonyl group, etc.; $R_1$ represents a substituted or unsubstituted alkyl, alkenyl or aryl group having 1 to 30 carbon atoms; A represents an —O—, —S—, —COO—, $$-\underset{|}{N}-R_{10},\quad -CO-\underset{|}{N}-R_{10}\quad \text{or}\quad -SO_2-\underset{|}{N}-R_{10}$$

group (wherein $R_{10}$ represents a hydrogen atom, or a substituted or unsubstituted alkyl group); B represents a hydroxyalkylene group; $R_2$, $R_3$, $R_7$ and $R_9$ each represents a hydrogen atom, a substituted or unsubstituted alkyl group, an aryl group, an alkoxy group, an aryloxy group, a halogen atom, an acyl group, an amido group, a sulfonamido group, a carbamoyl group or a sulfamoyl group; $R_6$ and $R_8$ represent a substituted or unsubstituted alkyl group, an aryl group, an alkoxy group, an aryloxy group, a halogen atom, an acyl group, an amido group, a sulfonamido group, a carbamoyl group, or a sulfamoyl group. In the general formula (I-3), substituent groups of the phenyl ring may be asymmetrical on right and left sides; and $R_4$ and $R_5$ each represents a hydrogen atom, a substituted or unsubstituted alkyl group, or an aryl group. $R_4$ and $R_5$, $R_6$ and $R_7$, and $R_8$ and $R_9$ may combine with each other to form a substituted or unsubstituted ring. $n_1$, $n_2$, $n_3$ and $n_4$ each represents a mean polymerization degree of an oxyalkylene group, and ranging from 2 to 50.

Preferred examples in the present invention are described below.

B preferably represents an oxyalkylene group containing 2 to 6 carbon atoms, more preferably an oxyethylene group, an oxypropylene group, an oxy(hydroxy)propylene group, an oxybutylene group and an oxystyrene group, particularly preferably an oxyethylene group.

$R_1$ preferably represents an alkyl, alkenyl or alkylaryl group containing 4 to 24 carbon atoms, and particularly preferably a hexyl group, a dodecyl group, an instearyl group, an oleyl group, a t-butylphenyl group, a 2,4-di-t-butylphenyl group, a 2,4-di-t-pentylphenyl group, a p-dodecylphenyl group, an m-pentadecaphenyl group, a t-octylphenyl group, a 2,4-dinonylphenyl group, an octylnaphthyl group, and the like.

$R_2$, $R_3$, $R_6$, $R_7$, $R_8$ and $R_9$ each preferably represents a substituted or unsubstituted alkyl group containing 1 to 20 carbon atoms, such as methyl, ethyl, 1-propyl, t-butyl, t-amyl, t-hexyl, t-octyl, nonyl, decyl, dodecyl, trichloromethyl, tribromomethyl, 1-phenylethyl, 2-phenyl-2-propyl, etc.; a substituted or unsubstituted aryl group, such as phenyl, p-chlorophenyl, etc.; a substituted or unsubstituted alkoxy or aryloxy group represented by the formula $-OR_{11}$ (wherein $R_{11}$ represents a substituted or unsubstituted alkyl or aryl group containing 1 to 20 carbon atoms); a halogen atom, such as chlorine, bromine, etc.; an acyl group represented by the formula $-COR_{11}$; an amido group represented by the formula $-NR_{12}COR_{11}$ (wherein $R_{12}$ represents a hydrogen atom, or an alkyl group containing 1 to 20 carbon atoms); a sulfonamido group represented by the formula $-NR_{12}SO_2R_{11}$; a carbamoyl group represented by the formula

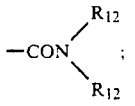

or a sulfamoyl group represented by the formula

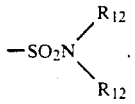

Further, $R_2$, $R_3$, $R_7$ and $R_9$ each may represent a hydrogen atom. Among the foregoing substituent groups, $R_6$ and $R_8$ each preferably represents an alkyl group or a halogen atom, and particularly preferably a tertiary alkyl group such as a t-butyl group, a t-amyl group, a t-octyl group or the like. A particularly preferred group as $R_7$ and $R_9$ is a hydrogen atom. Compounds of the general formula (I-3) prepared from 2,4-di-substituted phenols are particularly favored over others.

$R_4$ and $R_5$ each preferably represents a hydrogen atom; a substituted or unsubstituted alkyl group, such as a methyl group, an ethyl group, an n-propyl group, an i-propyl group, an n-heptyl group, a 1-ethylamyl group, an n-undecyl group, a trichloromethyl group, a tribromomethyl group, etc.; or a substituted or unsubstituted aryl group, such as an α-furyl group, a phenyl group, a naphthyl group, a p-chlorophenyl group, a p-methoxyphenyl group, an m-nitrophenyl group, etc. Also, $R_4$ and $R_5$, $R_6$ and $R_7$, and $R_8$ and $R_9$ may combine with each other to form a substituted or unsubstituted ring, e.g., a cyclohexane ring. Of the above-cited groups, particularly preferred as $R_4$ and $R_5$ each are a hydrogen atom, an alkyl group containing 1 to 8 carbon atoms, a phenyl group and a furyl group. $n_1$, $n_2$, $n_3$ and $n_4$ each is particularly preferably a number of 5 to 30. $n_3$ and $n_4$ may be the same or different.

These compounds are described, e.g., in U.S Pat. Nos. 2,982,651, 3,428,456, 3,457,076, 3,454,625, 3,552,972 and 3,655,337, Japanese Patent Publication No. 9610,76, Japanese Patent Application (OPI) Nos. 29715/78 and 89626/79, Japanese Patent Application Nos. 85764/82 and 90909/82, Hiroshi Horiguchi, *Shin Kaimen Kassei Zai* (which means "New Surface Active Agent"), Sankyo Shuppan, Tokyo (1975), and so on.

Specific examples of nonionic surface active agents which can be preferably employed in the present invention are illustrated below.

$C_{11}H_{23}COO(CH_2CH_2O)_8H$ III-1

$C_{15}H_{31}COO(CH_2CH_2O)_{15}H$ III-2

$C_{17}H_{33}COO(CH_2CH_2O)_5(CH_2CH(OH)CH_2)_3(CH_2CH_2O)_5H$ III-3

$C_8H_{17}O(CH_2CH_2O)_7H$ III-4

$C_{12}H_{25}O(CH_2CH_2O)_{10}H$ III-5

$C_{16}H_{33}O(CH_2CH_2O)_{12}H$ III-6

$C_{18}H_{35}O(CH_2CH(OH)CH_2O)_2(CH_2CH_2O)_{10}H$ III-7

$C_{22}H_{45}O(CH_2CH_2O)_{25}H$ III-8

III-9

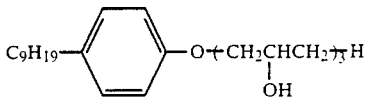

III-10

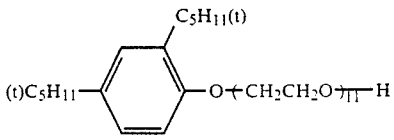

-continued
III-11
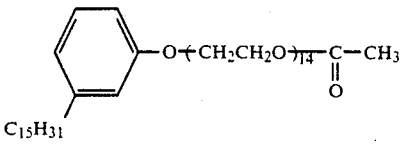
III-12
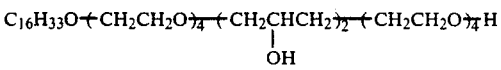
III-13
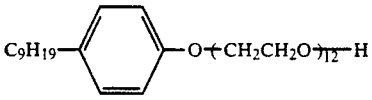
III-14
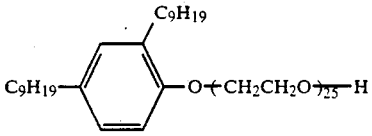
III-15
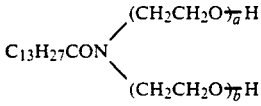
a + b = 15
III-16
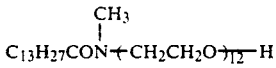
III-17
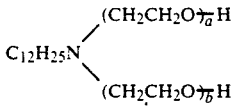
a + b = 20
III-18
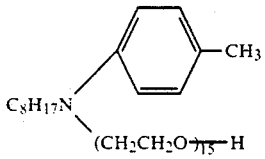
III-19
III-20
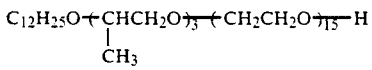
III-21
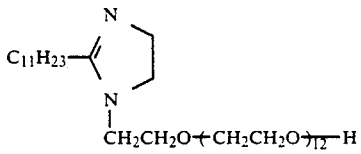
III-22
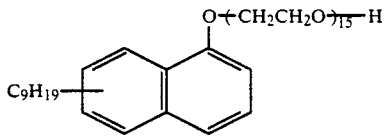
III-23
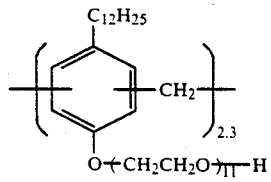

-continued
III-24
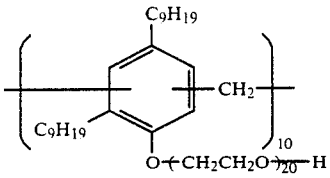
III-25
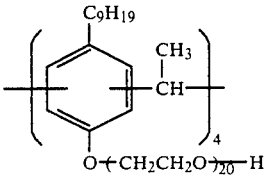
III-26
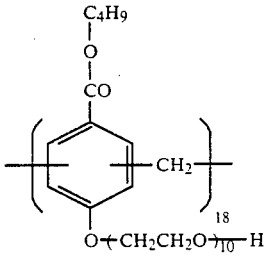
III-27
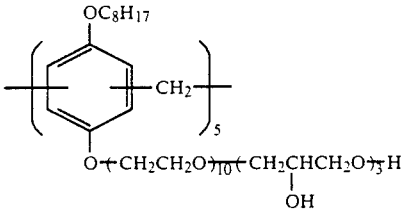
III-28
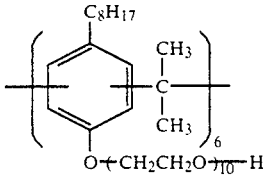
III-29
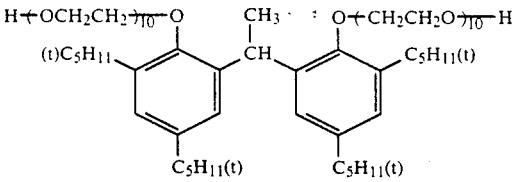
III-30
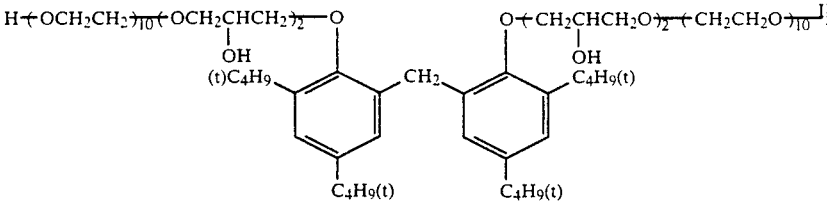
III-31
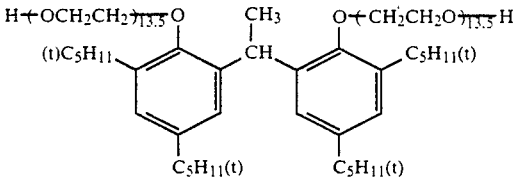

-continued

III-32

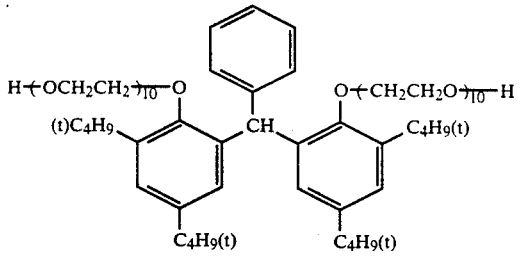

III-33

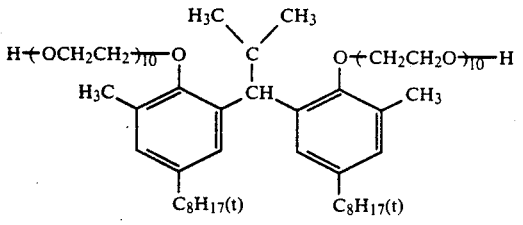

Examples of ionic surface active agents which can be preferably employed in the present invention are illustrated as formulae (II-1) to (II-25) shown hereinbefore.

The nonionic and ionic surface actibe agents of the present invention are added in an amount of 1 to 2,000 mg, preferably 3 to 500 mg, and particularly 5 to 300 mg, per square meter of the photographic material.

Also, these surface active agents each may be used alone or as a mixture of two or more thereof.

The nonionic and ionic surface active agents of the present invention are added to at least one layer located on the same side as the silver halide emulsion layers of the photographic material.

As examples of a constituent layer to which the surface active agents can be added, mention may be made of a surface protecting layer, an emulsion layer, an interlayer, a subbing layer and so on. When the surface protecting layer is constructed by two or more layers, the surface active agents may be added to any one of them. Also, they can be coated on the surface protecting layer as an overcoat.

In the layer containing the nonionic and ionic surface active agents of the present invention or other layers, another antistatic agent also can be used together, and thereby a more desirable antistatic effect can be gained. As examples of such antistatic agents, mention may be made of anions, cations, betaine polymers, fluorine-containing surface active agents, metal oxides, and so-called matting agents including barium sulfate, strontium sulfate, polymethylmethacrylate, methyl-methacrylate-methacrylic acid copolymers, colloidal silica, powdery silica and the like.

Fluorine-containing surface active agents are particularly effective as antistatic agents.

Suitable examples of fluorine-containing surface active agents include those containing as a fluorinated moiety a fluoroalkyl, fluoroalkenyl or fluoroaryl group containing not less than 4 carbon atoms, and as an ionic group an anionic group (e.g., a sulfonic acid group (or a sulfonate group), a sulfuric acid group (or a sulfate group), a carboxylic acid group (or a carboxylate group), or a phosphonic acid group (or a phosphate group), a cationic group (e.g., an amine salt, an ammonium salt, an aromatic amine salt, a sulfonium salt, or a phosphonium salt), a betaine group (e.g., a carboxyamine salt, a carboxyammoinum salt, a sulfoamine salt, a sulfoammonium salt, or a phosphoammonium salt) or a nonionic group (e.g., a substituted or unsubstituted polyoxyalkylene group, a polyglyceryl group, or a sorbitan residue).

Specific examples of such fluorine-containing surface active agents are described in Japanese Patent Application (OPI) No. 10722/74, British Patent 1,330,356, U.S. Pat. Nos. 4,335,201 and 4,347,308, British Patent 1,417,915, Japanese Patent Application (OPI) Nos. 149938/80 and 196544/83, British Patent 1,439,402, and so on.

Preferred examples of fluorine-containing surface active agents are illustrated below.

$C_8F_{17}SO_3K$ IV-1

$C_7F_{15}COONa$ IV-2

$C_9F_{17}CH_2CH_2OSO_3Na$ IV-3

$C_9F_{17}SO_2N(C_3H_7)-CH_2COOK$ IV-4

IV-5

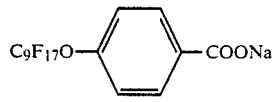

-continued

IV-6

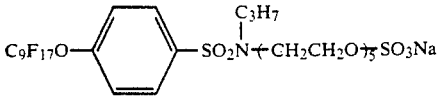

IV-7

$$C_8F_{17}SO_2N(C_3H_7)(CH_2CH_2O)_4(CH_2)_4SO_3Na$$

IV-8

$$C_8F_{17}SO_2N(C_3H_7)(CH_2CH(OH)CH_2O)_5SO_3K$$

IV-9

$$C_9F_{19}COOCH_2CH(OH)CH_2SO_3Na$$

IV-10

$$C_8F_{17}SO_2N(C_{12}H_{25})(CH_2CH(OH)CH_2O)_2(CH_2CH_2O)_2SO_3K$$

IV-11

$$C_8F_{17}CH_2CH_2OOC-CH_2$$
$$C_4H_9OOC-CH(SO_3Na)$$

IV-12

$$C_8F_{17}SO_2NH(CH_2)_3OCH_2CH_2\overset{\oplus}{N}(CH_3)_2-CH_2CH_2COO^{\ominus}$$

IV-13

$$C_8F_{17}SO_2NH(CH_2)_3\overset{\oplus}{N}(CH_3)_2(CH_2)_4SO_3^{\ominus}$$

IV-14

$$C_8F_{17}SO_2NH(CH_2)_2\overset{\oplus}{N}(CH_2CH_2OH)_2-CH_2COO^{\ominus}$$

IV-15

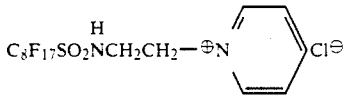

IV-16

$$C_8F_{17}SO_2NH(CH_2)_2\overset{\oplus}{N}(CH_3)_3-CH_3I^{\ominus}$$

IV-17

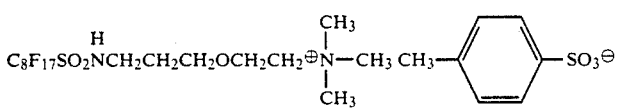

IV-18

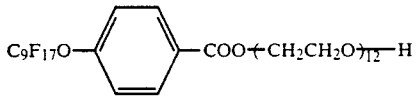

IV-19

$$C_8F_{17}SO_2N(C_{10}H_{21})(CH_2CH_2O)_{12.5}H$$

IV-20

$$C_6F_{13}SO_2N(CH_2CH_2O)_nH(CH_2CH_2O)_mH$$

n + m = 11.5

-continued

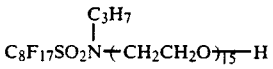

IV-21

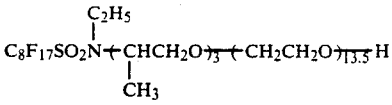

IV-22

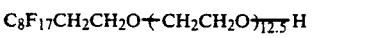

IV-23

IV-24

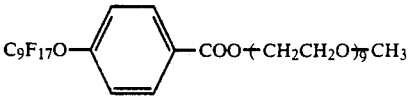

IV-25

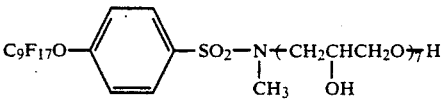

IV-26

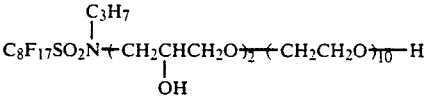

An appropriate coverage of these fluorinecontaining surface active agents ranges from 0.1 to 1,000 mg/m$^2$, preferably from 0.2 to 250 mg/m$^2$, and particularly preferably from 0.3 to 100 mg/m$^2$.

Furthermore, lubricant compositions, such as denatured silicone and the like, as described in U.S. Pat. Nos. 3,079,837, 3,080,317, 3,545,970 and 3,294,537, and Japanese Patent Application (OPI) No. 129520/77, can be contained in photographic constituent layers of the present invention.

Suitable examples of binders which can be used for photographic layers include proteins, such as gelatin, casein and the like; cellulose compounds, such as carboxymethyl cellulose, hydroxyethyl cellulose and the like; sugar derivatives, such as dextran, agar, sodium alginate, starch derivatives and the like; and synthetic hydrophilic colloids, such as colloids of polyvinyl alcohol, poly-N-vinylpyrrolidone, acrylic acid copolymers, polyacrylamide, derivatives thereof and partial hydrolysis products thereof. These binders can be used alone or as a mixture of two or more thereof.

The term gelatin as used herein is intended to include lime-processed gelatin, acid-processed gelatin, derived gelatin, and enzyme-processed gelatin.

As for the antihalation dyes and/or the irradiation inhibiting dyes which can be used in the present invention, dyes having a substantial absorption of light in long wavelengths beyond 750 nm can be employed. Specifically, the antihalation dyes can be used in an interlayer, a subbing layer, an antihalation layer, a backing layer, an emulsion layer and so on, while the irradiation inhibiting dyes can be used in not only an emulsion layer, but also an interlayer and so on. A preferred coverage of these dyes is $10^{-3}$ g/m$^2$ or above, particularly from $10^{-3}$ to 0.5 g/m$^2$. For example, dyes described in U.S. Pat. Nos. 2,895,955, 3,177,078 and 4,581,325, and Japanese Patent Application (OPI) No. 100116/75, and those as described in Japanese Patent Application No. 1629879/86 can be preferably used for the above-described purposes.

The photographic light-sensitive material of the present invention can contain, in a photographic constituent layer, polymer latexes as described in U.S. Pat. Nos. 3,411,911 and 3,411,912, and Japanese Patent Publication No. 5331/70 (e.g., polyethylacrylate latex, ethylacrylate-methacrylic acid copolymer latex, polystyrene latex, etc.).

The photographic light-sensitive material of the present invention is not particularly restricted as to the antifoggant, the stabilizer, the hardener, the plasticizer, the lubricant, the coating aid, the matting agent, the brightening agent, the dyes and so on, and descriptions, e.g., in *Research Disclosure,* Vol. 176, pp. 22–31 (December, 1978) can be referred to.

Photosensitive materials to which the method of the present invention can be applied include not only those capable of producing silver images (e.g., photosensitive materials for medical use, photosensitive materials for graphic arts, etc.), but also those capable of producing dye images (e.g., color photographic paper, color reversal paper, etc.).

As examples of constituent layers to which the surface active agents can be added, mention may be made of a surface protecting layer, an emulsion layer, an interlayer, a subbing layer and so on. When the surface protecting layer is constructed by two or more layers, the surface active agents may be added to any one of them. Also, they can be coated on the surface protecting layer as an overcoat.

Now, development, fixation, washing and drying steps to be carried out in the present invention, which is characterized by the development time not exceeding 15 seconds, are described below.

As for the developing agent to be used in a black-and-white developer of the present invention, combinations of dihydroxybenzenes and 1-phenyl-3-pyrazolidones are most desirable from the standpoint of facility in imparting excellent qualities to the developed images. Of course, a developing agent of p-aminophenol type may be additionally contained in the black-and-white developer.

Dihydroxybenzene type developing agents which can be used in the present invention include hydroquinone, chlorohydroquinone, bromohydroquinone, 2,3-dibromohydroquinone, isopropylhydroquinone, methylhydroquinone, 2,3-dichlorohydroquinone, 2,5-dimethylhydroquinone, and the like. In particular, hydroquinone is preferred over others.

Developing agents of the 1-phenyl-3-pyrazolidone type which can be used in the present invention include 1-phenyl-4,4-dimethyl-3-pyrazolidone, 1-phenyl-4-methyl-4-hydroxymethyl-3-pyrazolidone, 1-phenyl-4,4-dihydroxymethyl-3-pyrazolidone, and the like.

Developing agents of the p-aminophenol type which can be employed in the present invention include N-methyl-p-aminophenol, p-aminophenol, N-(β-hydroxyethyl)-p-aminophenol, N-(4-hydroxyphenyl)glycine, 2-methyl-p-aminophenol, p-benzylaminophenol, and the like. In particular, N-methyl-p-aminophenol is preferred over others.

In general, a developing agent is preferably used in an amount of 0.01 to 1.2 mol/liter.

Specific examples of sulfite type preservatives to be used in the present invention include sodium sulfite, potassium sulfite, lithium sulfite, ammonium sulfite, sodium bisulfite, sodium metabisulfite, formaldehyde sodium bisulfite, and the like. A preferred concentration of a sulfite is 0.2 mol/liter or more, particularly 0.4 mol/liter. The upper limit thereof is preferably 2.5 mol/liter.

A preferred pH of the developer to be used in the present invention is within the range of 9 to 13, particularly 10 to 12.

Alkali agents used for adjustment of pH include pH controlling agents such as potassium hydroxide, sodium carbonate, potassium carbonate, sodium tertiary phosphate, potassium tertiary phosphate, and the like.

For the above-described purpose, buffering agents such as those described in Japanese Patent Application No. 28708/86 (borates), those described in Japanese Patent Application (OPI) No. 93433/85 (e.g., saccharose, acetoxime, and 5-sulfosalicylic acid), phosphates, carbonates and so on may also be used.

Additives other than the above-described ingredients which can be contained in the developer include development inhibitors such as sodium bromide, potassium bromide, potassium iodide, etc.; organic solvents such as ethylene glycol, diethylene glycol, triethylene glycol, dimethylformamide, methyl cellosolve, hexylene glycol, ethanol, methanol, etc.; antifoggants such as mercapto compounds like 1-phenyl-5-mercaptotetrazole, sodium 2-mercaptobenzimidazole-5-sulfonate, etc., indazole compounds like 5-nitroindazole, etc., benzotriazole compounds like 5-methylbenzotriazole, etc., and so on.; and optionally, toning agents, surface active agents, defoaming agents, water softeners, and amino compounds as described in Japanese Patent Application (OPI) No. 106244/81, and so on.

In the developer to be used in the present invention, compounds described in Japanese Patent Application No. 24347/81 can be used as silver stain inhibitors.

In the developer to be used in the present invention, amino compounds like alkanolamines described in Japanese Patent Application (OPI) No. 106244/81 can be used.

In addition to the above-described additives, those described, e.g., in L.F.A. Mason, *Photographic Processing Chemistry*, pp. 226–229, Focal Press (1966), U.S. Pat. Nos. 2,193,015 and 2,592,364, Japanese Patent Application (OPI) No. 69433/73, and so on may be employed.

The terms "development time" and "fixation time" as used in the present invention mean the time from the beginning of a dip of a sensitive material to be developed in the developing tank solution of an automatic developing machine until the beginning of a dip in the subsequent fixer, and the time from the beginning of a dip in the fixing tank solution until the beginning of a dip in the subsequent washing tank (stabilizing bath), respectively.

The term "washing time" as used in the present invention means the time spent in dipping the sensitive material in a washing tank.

The term "drying time" as used in the present invention means the time spent in keeping the sensitive material in the drying zone with which the automatic developing machine is equipped. In general, the drying zone is designed so that hot wind of 35° to 100° C., preferably 40° to 80° C., may blow in the processed sensitive material.

As for the development temperature and time, a period of not longer than 15 seconds at about 25° C. to about 50° C. is adequate, and a period of from 6 seconds to 15 seconds at 30° to 40° C. is preferred.

A fixer is suitably an aqueous solution containing a thiosulfate, and adjusted to pH 3.8 or higher, preferably pH 4.2 to 5.5, and more preferably pH 4.65 to 5.5.

As for the fixing agent, sodium thiosulfate and ammonium thiosulfate can be cited. However, ammonium thiosulfate is particularly preferred in the respect that both thiosulfuric acid ion and ammonium ion are essential to the fixer, so that high fixing speed is achieved. The amount of the fixing agent can vary. In general, it ranges from about 0.1 mol/liter to about 6 mol/liter.

Water-soluble aluminum salts which function mainly as a hardener may be contained in the fixer. They include, e.g., aluminum chloride, aluminum sulfate, chrome alum, and so on.

In the fixer, tartaric acid, citric acid, gluconic acid and their derivatives can be used alone or in a combination of two or more thereof. These compounds are effective when contained in an amount of not less than 0.005 mol, particularly from 0.01 to 0.03 mol, per liter of fixer.

Specific examples of such compounds include tartaric acid, potassium tartarate, sodium tartarate, potassium sodium tartarate, citric acid, sodium citrate, potassium citrate, lithium citrate, ammonium citrate, and so on.

Further, the fixer can optionally contain preservatives (e.g., sulfites, bisulfites, etc.), pH buffering agents (e.g., acetic acid, boric acid, etc.), pH adjusting agents (e.g., sulfuric acid, etc.), chelating agents having an ability to soften hard water, and compounds described in Japanese Patent Application No. 218562/85.

As for the temperature and the time for fixation, a period of 6 seconds to 1 minute at about 20° C. to about 50° C. is preferable, that of 6 to 30 seconds at 30° C. to 40° C. is more preferable, and that of 6 to 15 seconds at 30° C. to 40° C. is particularly preferable.

When a concentrated liquid fixer is replenished together with water for dilution thereof in proportion as the sensitive materials are processed using an automatic developing machine in accordance with the method of the present invention, it is desired that the concentrated liquid fixer should consist of one reagent.

The fixer should have a pH 4.5 or higher, preferably a pH 4.65 or higher, to enable stable presence of the fixer stock as one reagent. When the fixer is present at a pH lower than 4.5, a thiosulfate therein comes to decompose by long-term storage before practical use, resulting in conversion to a sulfide. Accordingly, an extent of the evolution of sulfurous acid gas is diminished under a pH 4.5 or higher, and thereby working condition is improved. Though the upper limit of an allowable pH is not prescribed so severely, it is appropriate to set the upper limit to a pH about 7 or below, because the pH in the film becomes too high in spite of thorough washing when the sensitive film is fixed under too high a pH, resulting in considerable swelling of the film, and thereby increase in drying load.

When the hardening is carried out using an aluminum salt in the fixer, the upper limit of a pH is 5.5 or lower in respect of prevention of the aluminum salt from separating out and precipitating.

Either the developer or the fixer may be a so-called use solution which requires no water for dilution (that is, replenished with a stock solution as it is) in the present invention.

An amount of each concentrated processing solution to be supplied to the processing tank solution and a mixing ratio of each concentrated processing solution to diluting water can be changed variously depending on the composition of each condensed processing solution. In general, a mixing ratio of a concentrated solution to diluting water ranges from 1:0 to 1:8. These developers and fixers are preferably used in a total amount of 50 to 1,500 ml per $m^2$ of sensitive material to be processed.

After development and subsequent fixation, the sensitive material of the present invention is subjected to washing or stabilization processing.

All methods known in this field can be applied to the washing or stabilization processing, and water containing various kinds of additives known in this field can be employed as washing water or a stabilizing solution. Water into which a means of antimolding is introduced is preferably employed as washing water or a stabilizing solution, and thereby not only such a water-saving processing as to reduce an amount of the replenisher used to below 3 liters per square meter of sensitive material processed becomes feasible, but also a pipe arrangement for setting an automatic developing machine becomes unnecessary, and reduction in the number of stock tanks becomes possible. Namely, diluting water for a prepared liquid developer and a prepared liquid fixer, and washing water or a stabilizing solution can be supplied from a common stock tank. Therefore, an automatic developing mahcine can be rendered still more compact.

When water into which a means of antimolding is introduced is used together with washing water or a stabilizing solution, generation of fur and the like can be effectively prevented to enable such a water-saving processing as to use 0 to 3 liters, preferably 0 to 1 liter, of water per $m^2$ of sensitive material.

The expression "an amount replenished is zero" as used herein means that replenishment is not carried out, except only a decrement of washing water which generates through spontaneous evaporation or so on when the washing water is kept in the washing tank is properly supplemented, that is to say, a so-called "reservoired water" processing method, which is substantially free from replenishment, is carried out.

As for the method for reducing the amount of a replenisher, a multistage (e.g., two-stage, three-stage, etc.) countercurrent method has been known for a long time. When this multistage countercurrent method is applied to the present invention, more efficient washing can be achieved since the fixed sensitive material is processed step by step in the cleaner direction, that is to say, by contact successively with processing solutions which are less and less contaminated with the fixer. According to the above-described process, unstable thiosulfates and so on can be removed properly, and the possibilities of change in color and discoloration become still smaller to result in acquisition of more remarkable stabilization effect. In addition, washing water can answer the purpose in a very small amount, compared with conventional processes.

When washing is carried out using a small amount of washing water, it is more advantageous to set a washing tank equipped with squeegee rollers as described in Japanese Patent Application No. 172968/85.

Further, a portion or all of the overflow from a washing bath or a stabilizing bath, which is generated by replenishing the washing bath or the stabilizing bath with the water, in which a means of antimolding is introduced, depending on the quantity of processed materials, can be utilized by a processing solution having fixability, which is used in the step prior to the washing or stabilizing step, as described in Japanese Patent Application (OPI) No. 235133/85. The utilization of the overflow, as described above, is advantageous in that the foregoing stock water can be saved, and, what is more, waste water can be reduced.

As examples of means of antimolding which can be used, mention may be made of the ultraviolet irradiation method described in Japanese Patent Application (OPI) No. 263939/85, the magnetic field application method described in Japanese Patent Application (OPI) No. 263940/85, the method of purifying water with ion exchange resins described in Japanese Patent Application (OPI) No. 131632/86, and the method of using an antibacteria agent described in Japanese Patent Application Nos. 235807/85, 295894/85, 63030/86 and 51396/86.

In addition to the foregoing methods, antibacteria agents, antimold agents, surface active agents and so on, as described in a paper by L. E. West, entitled "Water Quality Criteria", presented in *Photo Sci. & Eng.*, Vol. 9, No. 6 (1965), a paper by M. W. Beach, entitled "Microbiological Growths in Motion-Picture Processing", presented in *SMPTE Journal*, Vol. 85 (1976), a paper by R. O. Deegan, entitled "Photo Processing Wash Water Biocides", presented in *J. Imaging Tech.*, Vol. 10, No. 6 (1984), Japanese Patent Application (OPI) Nos. 8542/82, 58143/82, 105145/83, 132146/82, 18631/83, 97530/82 and 157244/82, and so on can be used together.

Further, isothiazoline compounds described in R. T. Kreiman, *J. Image Tech.*, Vol. 10, No. 6, p. 242 (1984), isothiazoline compounds described in *Research Disclosure*, Vol. 205, Item 20526 (May, 1981), isothiazoline compounds described in *Research Disclosure*, Vol. 228, Item 22845 (April, 1983), and compounds described in Japanese Patent Application No. 51396/86 and so on can be used as microbiocides in the washing bath.

Specific examples of antimold agents which can be used include phenol, 4-chlorophenol, pentachlorophenol, cresol, o-phenylphenol, chlorophene, dichlorophene, formaldehyde, glutaraldehyde, chloroacetamide, p-hydroxybenzoic acid esters, 2-(4-thiazoline)-benzimidazole, benzoisothiazoline-3-one, dodecylbenzyldimethylammonium chloride, N-(fluorodichloromethylthio)phthalimide, 2,4,4'-trichloro-2'-hydroxydiphenyl ether, and so on.

Water preserved in a stock tank, in which an antimold means is introduced, is preferably used commonly as diluting water for the above-described stock solutions of processing solutions such as a developer, a fixer and so on, and as washing water, because thereby a small space is usable for operating an automatic developing machine. On the other hand, prepared liquid diluting water and washing water (or a stabilizing solution), in which an antimolding means is introduced, can be kept in separate tanks, or either of them may be supplied directly from city water.

When the diluting water and washing water are kept in separate tanks, the washing water (or a stabilizing bath) preferably has an antimold means; besides which it can also contain various kinds of additives.

For instance, chelating compounds having a stability constant of 10 or above, expressed in logK, when forming aluminum chelates, may be contained. They are effective in preventing white precipitates from generating in washing water when the fixer contains an aluminum compound as a hardener.

Specific examples of chelating agents which can be used include ethylenediaminetetraacetic acid (logK=16.1), cyclohexanediaminetetraacetic acid (logK=17.6), diaminopropanoltetraacetic acid (logK=13.8), diethylenetriaminepentaacetic acid (logK=18.4), triethylenetetraminehexaacetic acid (logK=19.7), and sodium, potassium and ammonium salts thereof. These chelating agents are added in an amount of 0.01 to 10 g/liter, preferably 0.1 to 5 g/liter.

In addition to silver image stabilizing agents, various kinds of surface active agents can be added to washing water for the purpose of the prevention of water marks. As surface active agents, those of any type, e.g., cationic, anionic, nonionic or amphoteric, may be used. Specific examples of surface active agents which can be used include compounds described, e.g., in *Handbook of Surface Active Agents,* published by Kogaku Tosho Co., Ltd.

To the foregoing stabilizing bath, various kinds of compounds may be added for the purpose of the stabilization of images. As representatives of such compounds, various kinds of buffering agents for adjusting the pH in the film properly (e.g., a pH 3 to 8), with specific examples including borates, metaborates, borax, phosphates, carbonates, potassium hydroxide, sodium hydroxide, aqueous ammonia, monocarboxylic acids, dicarboxylic acids, polycarboxylic acids, and so on, which are used in combination, and aldehyde compounds like formaldehyde can be added. Further, chelating agents, pasteurizing agents (of thiazole type, isothiazole type, halogenated phenol type, sulfanylamide type, benzotriazole type, etc.), surface active agents, brightening agents, hardeners and other additives may be used in the stabilizing solution. Two or more additives having the same purpose, or different purposes respectively can be used together.

Furthermore, it is desirable for improvement in image-keeping quality to add various kinds of ammonium salts, such as ammonium chloride, ammonium nitrate, ammonium sulfate, ammonium phosphate, ammonium sulfite, ammonium thiosulfate, and so on, as an agent for adjusting the pH in the processed film to a proper value.

As for the washing or stabilizing bath temperature and the time spent in the washing or stabilization bath prepared in accordance with the method as described above, a period of 6 seconds to 1 minute at 0° to 50° C. is preferable, that of 6 to 30 seconds at 5° to 40° C. is more preferable, and that of 6 to 15 seconds at 15° to 40° C. is particularly preferable.

In accordance with the process of the present invention, washing water is squeezed out from the photographic material which has received development, fixation and washing processings, that is, the squeegee roller process is performed, and then the resultant photographic material is dired. The drying is carried out at about 40° to about 100° C. The drying time, though it can be changed depending on environmental conditions, is generally from about 5 seconds to 1 minute, preferably from about 5 seconds to about 30 seconds at 40° to 80° C.

The present method can achieve an excellent effect in that the drying time can be reduced to a greater extent as the swelling percentage of the sensitive material can be made smaller.

In accordance with the present invention, a so-called dry to dry processing time, or a time required for accomplishing development, fixation, washing and drying processings, can be reduced to less than 3 minutes and 15 seconds, desirably less than 100 seconds, and more desirably less than 60 seconds. In addition to reduction of the processing time as described above, the simplification of preparation works for replenishers of the developer and the fixer, which is due to their one-part constitution, and the simplification of the maintenance of these solutions can be attained at the same time.

The term "dry to dry processing time" as used herein refers to the time from the moment when the front of a sensitive material to be processed enters the film insertion inlet of an automatic developing machine to the moment when the front of the processed sensitive material emerges from the outlet of the automatic developing machine.

The photographic light-sensitive material of the present invention can contain, in a photographic constituent layer, polymer latexes as described in U.S. Pat. Nos. 3,411,911 and 3,411,912, and Japanese Patent Publication No. 5331/70.

The photographic light-sensitive material of the present invention is not particularly restricted as to the antifoggant, the stabilizer, the hardener, the plasticizer, the lubricant, the coating aid, the matting agent, the brightening agent, the dyes and so on, which are to be used in a silver halide emulsion layer or/and a surface protecting layer, and descriptions, e.g., in *Research Disclosure,* Vol. 176, pp. 22-31 (December, 1978) can be referred to.

Photosensitive materials to which the method of the present invention can be applied include not only those capable of producing silver images (e.g., photosensitive materials for medical use, photosensitive materials for graphic arts, etc.), but also those capable of producing dye images (e.g., color photographic paper, color reversal paper, etc.).

The present invention is illustrated in greater detail by reference to the following examples. However, the invention should not be construed as being limited to these examples.

EXAMPLE 1

(1) Preparation of Silver Halide Emulsion

To gelatin, potassium bromide and water placed in a vessel heated to 55° C. was added an appropriate quantity of aqueous ammonia. To the resulting mixture were added both an aqueous solution of silver nitrate and an aqueous solution of potassium bromide, to which a hexachloroiridate(III) was added in advance in an Ir/Ag ratio of $10^{-7}$ by mol, according to the double jet process as the pAg value in the reaction vessel was kept at 7.60, resulting in preparation of monodispersed silver bromide emulsion grains having a mean grain size of 0.55 micron (98% of these emulsion grains had their individual sizes within the range of ±40%). After the desalting treatment, the emulsion was adjusted to a pH 6.2 and a pAg 8.6, and then subjected to gold-sulfur sensitization using sodium thiosulfate and chloroauric acid to result in acquisition of intended photographic properties. This emulsion was named A. A ratio of (100) face to (111) face in Emulsion A was 98/2 when measured on a basis of Kubelka-Munk model.

(2) Preparation of Coating Composition of Emulsion

A 1 kg portion of Emulsion A was weighed out, and heated to 40° C. to be converted into a solution. Thereto was added 70 ml of a methanol solution of the infrared region sensitizing dye illustrated by structural formula A ($9\times10^{-4}$ mol/liter), 90 ml of disodium 4,4'bis[4,6-di(-naphthyl-2-oxy) pyridine-2-ylamino]stilbene-2,2'-disulfonate as supersensitizing dye ($4.4\times10^{-3}$ mol/liter), 35 ml of a methanol solution of the compound illustrated by structural formula B ($2.8\times10^{-2}$ mol/liter), a water solution of 4-hydroxy-6-methyl-1,3,3*a*,7-tetraazaindene, a water solution of a dodecylbenzenesulfonate as a coating aid, a water solution of poly(potassium-p-vinylbenzenesulfonate) as a viscosity increasing agent, and a water solution of polyacrylamide (molecular weight: 40,000) to prepare a coating solution of Emulsion A.

Structural Formula A

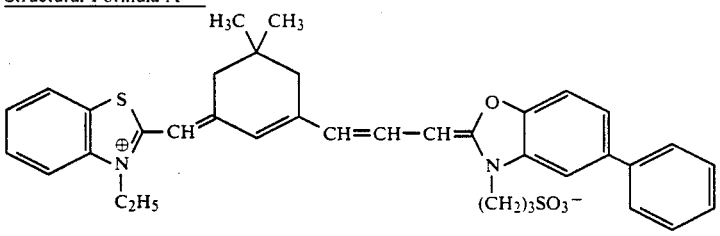

Structural Formula B

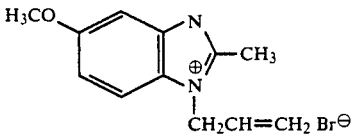

(3) Preparation of Coating Composition for Emuslion Surface Protecting Layer

To a 10 wt % of aqueous gelatin solution heated to 40° C. were added a water solution of polyacrylamide (molecular weight: 10,000), a water solution of sodium polystyrenesulfonate as a viscosity increasing agent, fine particles of polymethylmethacrylate as a matting agent (mean particle size: 3.0 micron), 1,3-bis(vinylsulfonyl)propanol-2 as a hardener, a water solution of sodium perfluorooctanesulfonate as an antistatic agent, a water solution of polyoxyethylene (n=10) cetyl ether, and the surface active agent of the present invention (the kind and the amount of which are set forth in Table 1).

(4) Preparation of Coating Composition for Backing Layer

To a 1 kg portion of a 10 wt % aqueous gelatin solution heated to 40° C. were added an aqueous solution of sodium polystyrenesulfonate as a viscosity increasing agent, 50 ml of an aqueous solution of the dye of structural formula C illustrated below ($5\times10^{-2}$ mol/liter), and an aqueous solution of N,N'-ethylenebis(vinylsulfonylacetamide) as a hardener to prepare a coating composition.

Structural Formula C

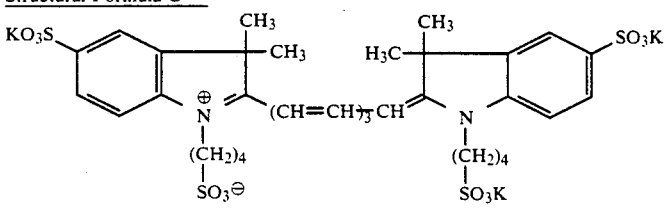

(5) Preparation of Coating Composition for Protection of Backing Layer Surface

To a 10 wt % of aqueous gelatin solution heated to 40° C. were added an aqueous solution of sodium polystyrenesulfonate as a viscosity increasing agent, polymethylmethacrylate fine particles (mean particle size: 4.2 microns) as a matting agent, aqueous solutions of sodium t-octylphenoxyethoxyethoxyethanesulfonate and sodium nonylphenoxybutanesulfonate as coating aids, polyoxyethylene (n=10) cetyl ether, and an aqueous solution of potassium perfluorooctanesulfonate as an antistatic agent to prepare a coating composition.

(6) Preparation of Coated Sample

The foregoing coating composition for a backing layer was coated together with the foregoing coating composition for protection of backing layer surface on one side of a polyethylene terephthalate film support at a coverage of 4 g/m$^2$ on a gelatin basis. Subsequently, the coating composition of the emulsion in which an infrared sensitizing dye was incorporated and the coating composition for protection of the emulsion layer surface were coated on the other side of the support at a coverage of 3.5 g/m$^2$ on a silver basis.

The thus-obtained sample films were examined for contact influence upon photographic quality and development mark using the methods described below, respectively.

(a) Evaluation of Contact Influence upon Photographic Quality

Sample film pieces measuring 4 cm×4 cm in size were allowed to stand for 3 hours under the condition of 25° C., 70% RH for the purpose of humidity control. They were superimposed on one another so that the light-sensitive layer side of one piece and the backing layer side of another piece were in contact with each other, placed in a bag which had received the same humidity control as described abobe, and sealed therein. On the thus-conditioned sample was uniformly imposed a load of 1 kg. After the lapse of 1 week under 25° C., the sample was subjected to photographic processings described below. Nonuniformity in the photographic property thus obtained was evaluated classifying into four ranks.

A: Nonuniformity was not observed at all in the developed images.

B: Nonuniformity was somewhat observed in the developed images.

C: Nonuniformity was considerably observed in the developed images.

D: Nonuniformity was observed almost all over the surface of the developed images.

The developer and the fixer used had the following compositions, respectively.

| Composition of Developer: | |
|---|---|
| Potassium Hydroxide | 17 g |
| Sodium Sulfite | 60 g |
| Diethylenetriaminetetraacetic Acid | 2 g |
| Potassium Carbonate | 5 g |
| Boric Acid | 3 g |
| Hydroquinone | 25 g |
| Diethylene Glycol | 12 g |
| 4-Hydroxymethyl-4-methyl-1-phenyl-3-pyrazolidone | 16.5 g |
| 5-Methylbenzotriazole | 0.6 g |
| Acetic Acid | 1.8 g |
| Potassium Bromide | 2 g |

-continued

| | |
|---|---|
| Water to make | 1 liter |
| pH adjusted to | 10.35 |
| Composition of Fixer: | |
| Ammonium Thiosulfate | 140 g |
| Sodium Sulfite | 15 g |
| Disodium Ethylenediaminetetraacetate Dihydrate | 25 mg |
| Sodium Hydroxide | 6 g |
| Water to make | 1 liter |
| Acetic acid to adjust pH to | 4.95 |

The photographic processing comprised the following steps.

| Step | Temperature (°C.) | Time (sec) |
|---|---|---|
| Development | 35 | 11.5 |
| Fixation | 35 | 12.5 |
| Washing | 20 | 7.5 |
| Drying | 60 | |

The dry to dry processing time spent in this photographic processing was 60 seconds.

(b) Evaluation Method of Development Marks

Film samples measuring 35 cm×25 cm in size were subjected to the above-described photographic processing including development, fixation, washing and drying steps, and the development marks generated therein were evaluated classifying into the following four ranks.

A: Development marks were not observed at all.

B: Development marks were somewhat observed.

C: Development marks were considerably observed.

D: Development marks were observed almost all over the surface of the developed images.

(c) Evaluation of Spreadability of Coating Compositions:

The spreadability of the coating compositions was expressed in terms of the number of cissings present in the sample film having the width of 25 cm and the length of 10 m. That is to say, this means that the greater the number of cissings becomes, the worse spreadability the coating composition was.

TABLE 1

| Sample No. | Protective Layer on Emulsion Layer Side Surface Active Agent (mg/m²) | Characteristics of Surface Active Agent Used: Solubility in Developer (30° C.) | Characteristics of Surface Active Agent Used: Surface Tension (dyne/cm) | Contact Influence on Photographic Quality | Development Marks | Spreadability upon Coating (number of spots) |
|---|---|---|---|---|---|---|
| 1-1 (Control) | — | — | 72 (water) | A | D | above 1,000 |
| 1-2 (Invention) | II-1* (25) | above 0.005% | 33 | A | A | 2 |
| 1-3 (Invention) | II-3* (15) | " | 28 | A | A | 0 |
| 1-4 (Invention) | II-4* (20) | " | 27 | A | A | 1 |
| 1-5 (Invention) | II-11* (15) | " | 30 | A | A | 4 |
| 1-6 (Invention) | II-14* (20) | " | 30 | B | A | 2 |
| 1-7 (Invention) | II-19* (10) | " | 31 | A | A | 1 |
| 1-8 (Comparison) | (a)** (15) | below 0.005% | 28 | A | D | 1 |
| 1-9 (Comparison) | (b)** (20) | " | 30 | B | D | 3 |

TABLE 1-continued

| Sample No. | Protective Layer on Emulsion Layer Side: Surface Active Agent (mg/m²) | Characteristics of Surface Active Agent Used: Solubility in Developer (30° C.) | Surface Tension (dyne/cm) | Contact Influence on Photographic Quality | Development Marks | Spreadability upon Coating (number of spots) |
|---|---|---|---|---|---|---|
| 1-10 (Comparison) | (c)** (20) | above 0.005% | 50 | A | D | above 1,000 |

*The surface active agents of the present invention.
**Comparative compounds.

(a):

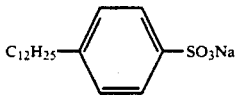

(b): $C_{16}H_{33}O(CH_2CH_2O)_{10}H$
(c): $C_2H_5OSO_3Na$

As can be seen from the results shown in Table 1, Sample Nos. 1-12 to 1-7, in which the surface active agents of the present invention were incorporated respectively acquired satisfactory properties in respects of the contact influence on photographic quality, the development marks and the spreadability upon coating, that is, produced images of excellent quality. In contrast to the samples of the invention, Control Sample 1-1 generated development marks, and was remarkably inferior in spreadability.

On the other hand, Sample Nos. 1-8 to 1-11, in which comparative compounds having a solubility of 0.005 wt % or less in the developer or a surface tension of 45 dyne or above were incorporated respectively, were much inferior to the samples of the present invention in the respect that development marks were observed to a marked extent.

Accordingly, the superiority of the present invention is evident.

EXAMPLE 2

(1) Preparation of Monodispersed Silver Halide Emulsion

A monodispersed silver halide emulsion having a mean grain size of 0.35 micron was prepared in the same manner as in Example 1-(1), except that the amount of aqueous ammonia added prior to the grain formation was decreased. Then, the emulsion was desalted, and subjected to gold-sulfur sensitization under such a condition as to acquire the optimum sensitivity. This emulsion was named B.

(2) Preparation of Coating Composition for Emulsion Layer

A coating composition was prepared in the same manner as in Example 1-(2), except that a mixture of 500 g of Emulsion A and 500 g of Emulsion B was used in place of Emulsion A.

(3) Preparation of Coating Composition of Emulsion Layer Surface Protecting Layer A coating composition was prepared in the same manner as in Example 1-(3), except that a mixture of a water solution of $$C_8H_{17}SO_2\overset{\overset{C_3H_7}{|}}{N}(CH_2CH_2O)_4(CH_2)_4SO_3Na$$

and a water solution of $$C_8H_{17}SO_2\overset{\overset{C_3H_{17}}{|}}{N}(CH_2CH_2O)_{16}H$$

was used in place of the water solution of sodium perfluorooctanesulfonate.

The samples shown in Table 2 were prepared in the same manner as in Example 1, and examined for the contact influence upon photographic quality and development marks.

As can be seen from the results shown in Table 2, the samples of the present invention had no problems regarding the contact influences upon photographic quality, development marks and spreadability upon coating, and were superior to the comparative sample.

TABLE 2

| Sample No. | Protective Layer on Emulsion Layer Side: Surface Active Agent (mg/m²) | Characteristics of Surface Active Agent Used: Solubility in Developer (30° C.) | Surface Tension (dyne/cm) | Contact Influence on Photographic Quality | Development Marks | Spreadability upon Coating (number of spots) |
|---|---|---|---|---|---|---|
| 2-1 (Control) | — | — | 72 (water) | A | D | above 1,000 |
| 2-2 (Invention) | II-3* (20) | above 0.005% | 28 | A | A | 2 |
| 2-3 (Invention) | II-4* (18) | " | 27 | A | A | 1 |
| 2-4 (Invention) | II-11* (20) | " | 30 | B | A | 3 |
| 2-5 (Invention) | II-14* (25) | " | 30 | A | A | 5 |
| 2-6 (Invention) | II-16* (30) | " | 31 | B | B | 6 |

TABLE 2-continued

| Sample No. | Protective Layer on Emulsion Layer Side: Surface Active Agent (mg/m²) | Characteristics of Surface Active Agent Used: Solubility in Developer (30° C.) | Surface Tension (dyne/cm) | Contact Influence on Photographic Quality | Development Marks | Spreadability upon Coating (number of spots) |
|---|---|---|---|---|---|---|
| 2-7 (Comparison) | (d)** (20) | below 0.005% | 27 | A | D | 2 |

*The surface active agents of the present invention.

**The surface active agent employed for comparison, which has the following structural formula:

$$C_8H_{17}OCO-\underset{\displaystyle C_8H_{17}OCOCH_2}{\underset{|}{CH}}-SO_2Na$$

EXAMPLE 3

(1) Preparation of Coating Composition for Emulsion Layer

A 0.5 kg portion of Emulsion A and a 0.5 kg portion of Emulsion B were weighed out, and heated to 40° C. to be converted into a solution. Thereto were added 70 ml of a methanol solution of the infrared region sensitizing dye illustrated by structural formula C ($9\times10^{-4}$ mol/liter), 90 ml of a water solution of disodium 4,4'-bis[4,6-di(naphthyl-2-oxypyridine-2-ylamino]stilbene-2,2'-disulfonate as a supersensitizing dye ($4.4\times10^{-3}$ mol/liter), 35 ml of a methanol solution of the compound illustrated by structural formula B ($2.8\times10^{-2}$ mol/liter), a water solution of 4-hydroxy-6-methyl-1,3,3*a*,7-tetraazaindene, a water solution of a dodecylbenzenesulfonate as a coating aid, a water solution of poly(potassium-p-vinylbenzenesulfonate) as a viscosity increasing agent, and a water solution of polyacrylamide (molecular weight: 8,000, coverage: 0.2 g/m²) and dextran (molecular weight: 30,000) to prepare a coating composition of the emulsion.

Structural Formula C

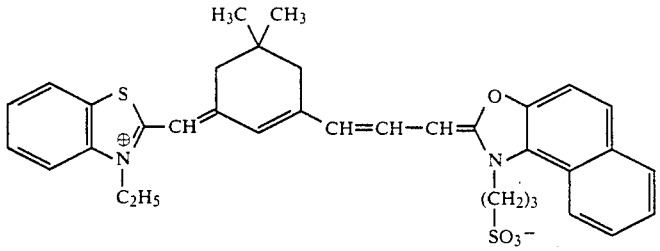

(2) Preparation of Coating Composition for Outermost Protective Layer on Light-Sensitive Emulsion Layer Side To a 10 wt % of aqueous gelatin solution heated to 40° C. were added a water solution of sodium polysthrenesulfonate as a viscosity increasing agent, fine particles of polymethylmethacrylate as a matting agent (mean particle size: 3.0 microns), 1,3-bis(vinylsulfonyl)-propanol-2 as a hardener, a water solution of sodium t-octylphenoxyethoxyethoxyethanesulfonate and sodium p-nonylphenoxybutanesulfonate as coating aids, a water solution of a surface active agent of polyethylene type (polyoxyethylene cetyl ether) and a water solution of the fluorine-containing surface active agents illustrated below as antistatic agents, and one of the polymers of the present invention, as set forth in Table 1, in an amount given therein, too, to prepare a coating composition.

$C_8F_{17}SO_3K$, $C_8F_{17}SO_2N(C_3H_7)(CH_2CH_2O)_{15}H$, and $C_8F_{17}SO_2N(C_3H_7)(CH_2CH_2O)_{14}(CH_2)_4SO_3Na$ (3) Preparation of Coating Composition for Backing Layer A coating composition was prepared in the same manner as disclosed in the paragraph (4) of Example 1.

(4) Preparation of Coating Composition for Outermost Layer on the Side of Backing Layer To a 10 wt % of aqueous gelatin solution heated to 40° C. were added, an aqueous solution of sodium polystyrenesulfonate as a viscosity increasing agent, polymethylmethacrylate fine particles (mean particle size: 4.2 microns) as a matting agent, an aqueous solutions of sodium t-octylphenoxyethoxyethoxyethanesulfonate as a coating aid, and aqueous solutions of the surface active agent of polyethylene type (polyoxyethylene p-nonylphenyl ether) and the fluorine-containing compounds of the following chemical structures as an antistatic agent to prepare a coating composition.

$C_8F_{17}SO_3K$ and $C_8F_{17}SO_2N(C_3H_7)(CH_2CH_2O)_{14}(CH_2)_4SO_3K$ (5) Preparation of Coated Sample On one side of a polyethylene terephthalate film support was coated the foregoing coating composition for a backing layer as well as the foregoing coating composition for the outermost layer on the backing layer side at a coverage of 4 g/m² on a gelatin basis. Subsequently, the coating composition for the emulsion described in (2), in which an infrared sensitizing dye was incorporated, and the coating composition for the outermost layer on the emulsion layer side were coated on the other siee of the support at a coverage of 3.5 g/m² on a silver basis.

The thus-obtained sample films were examined for development marks, photographic sensitivity, and static marks on urethane rollers used in a laser scanner part and an automatic developing machine part.

(6) Evaluation of Static Marks

In order to examine to what extent the static marks generated due to friction with other materials, unexposed sample films were each allowed to stand for 2 hours in the atmosphere of 25° C., 10% RH to condition its moisture content, and then two pieces of the sample were rubbed with a urethane rubber roller and a nylon roller, respectively, in a dark room air-conditioned at 25° C. and 10% RH, and then further subjected to the photographic processing described below.

An extent of static mark generation was evaluated classifying into four ranks.

A: Generation of static marks were not observed at all.
B: Generation of static marks were somewhat observed.
C: Generation of static marks were considerably observed.
D: Generation of static marks were observed almost all over the surface.

The developer and the fixer used had the following compositions, respectively.

| | |
|---|---|
| Composition of Developer: | |
| Potassium Hydroxide | 17 g |
| Sodium Sulfite | 60 g |
| Diethylenetriaminetetraacetic Acid | 2 g |
| Potassium Carbonate | 5 g |
| Boric Acid | 3 g |
| Hydroquinone | 25 g |
| Diethylene Glycol | 12 g |
| 4-Hydroxymethyl-4-methyl-1-phenyl-3-pyrazolidone | 16.5 g |
| 5-Methylbenzotriazole | 0.6 g |
| Acetic Acid | 1.8 g |
| Potassium Bromide | 2 g |
| Water to make | 1 liter |
| pH adjusted to | 10.35 |
| Composition of Fixer: | |
| Ammonium Thiosulfate | 140 g |
| Sodium Sulfite | 15 g |
| Disodium Ethylenediaminetetraacetate | 25 mg |

-continued

| | |
|---|---|
| Dihydrate | |
| Sodium Hydroxide | 6 g |
| Water to make | 1 liter |
| Acetic acid to adjust pH to | 4.95 |

The photographic processing comprised the following steps.

| Step | Temperature (°C.) | Time (sec) |
|---|---|---|
| Development | 35 | 11.5 |
| Fixation | 35 | 12.5 |
| Washing | 20 | 7.5 |
| Drying | 60 | |

The dry to dry processing time spent in this photographic processing was 60 seconds.

(8) Evaluation of Development Marks

Each sample film was tested and evaluated in the same manner as disclosed in paragraph (6)(a) of Example 1.

A: Development marks were not observed at all.
B: Development marks were somewhat observed.
C: Development marks were considerably observed.
D: Development marks were observed almost all over the surface of the developed images.

(8) Evaluation of Photographic Sensitivity

Each sample film was wedgewise exposed by means of a semiconductor laser scanner having a wavelength of 780 nm. After exposure, the sample film was subjected to development, fixation, and washing steps in the same manner as described above. Thus, strips with intended black-and-white images were obtained. Density measurements of these images were performed using a P-type densitometer made by Fuji Photo Film Co., Ltd. to determine sensitivity and fog. A standard point of the optical density to determine the sensitivity was fog +0.3.

TABLE 3

| Sample No. | Polymer Used and Content Thereof ($g/m^2$) | Content of Gelatin ($g/m^2$) | Static Marks: Urethane Rubber Roller | Static Marks: Nylon Roller | Development Marks | Photographic Sensitivity |
|---|---|---|---|---|---|---|
| 3-1 (Control) | — | 1.47 | A | A | D | 100 |
| 3-2 (Invention) | I-1 (0.11) | 1.36 | A | A | A | 103 |
| 3-3 (Invention) | I-1 (0.74) | 0.74 | A | A | A | 112 |
| 3-4 (Invention) | I-2 (0.29) | 1.18 | A | A | A | 106 |
| 3-5 (Invention) | I-5 (0.25) | 0.75 | B | A | A | 105 |
| 3-6 (Invention) | I-8 (0.25) | 0.45 | A | A | A | 109 |
| 3-7 (Invention) | I-12 (0.48) | 1.12 | A | B | A | 107 |
| 3-8 (Comparison) | I-1 (0.03) | 1.43 | A | A | C | 101 |
| 3-9 (Comparison) | I-5 (0.05) | 1.67 | A | A | D | 100 |
| 3-10 (Comparison) | (a)* (0.02) | 1.47 | D | B | A | 98 |
| 3-11 (Comparison) | (b)* (0.03) | 1.47 | C | D | A | 99 |
| 3-12 (Comparison) | (c)* (0.25) | 0.75 | B | C | D | 94 |

TABLE 3-continued

| Sample No. | Polymer Used and Content Thereof ($g/m^2$) | Content of Gelatin ($g/m^2$) | Static Marks: Urethane Rubber Roller | Static Marks: Nylon Roller | Development Marks | Photographic Sensitivity |
|---|---|---|---|---|---|---|
| 3-13 (Comparison) | (d)* (0.25) | 0.75 | A | B | D | 92 |

*Comparative polymers.

(a):

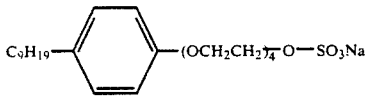

(b):

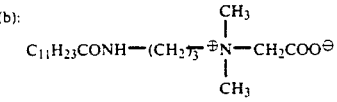

(c): $-(CH_2CH)_n-$ (OH) (molecular weight: about 20,000)

(d): $-(CH_2CH)_n-$ (COONa) (molecular weight: about 80,000)

As can be seen from the results shown in Table 3, Sample Nos. 3-2 to 3-7 in which the polymers of the present invention were contained respectively hardly generated static marks and development marks, had high photographic sensitivities and produced images of excellent quality. In contrast to the present samples, the control sample generated the development marks to a marked extent, and samples for comparison (Sample Nos. 3-8 and 3-9) were unable to achieve satisfactory effects because of their respective low contents to generate the development marks. Further, samples for comparison (Sample Nos. 3-10 and 3-11) in which surface active agents for comparison were employed respectively were certainly improved in development mark, but generated the static marks to a great extent. Other samples for comparison (Sample Nos. 3-12 and 3-13) in which polymers for comparison were employed had no improvement in development mark and were attended by a considerable decrease in photographic sensitivity. As described above, it is apparent that the photographic materials utilizing the polymers of the present invention are able to produce excellent images even when development processed in a short time.

EXAMPLE 4

(1) Preparation of Coating Composition of Emulsion

A coating composition was prepared in the same manner as disclosed in paragraph (1) of Example 3.

(2) Preparation of Coating Composition for Outermost Layer on the Side of Light-Sensitive Emulsion Layer To a 10 wt % of aqueous gelatin solution heated to 40° C. were added a water solution of sodium polystyrenesulfonate as a viscosity increasing agent, fine particles of polymethylmethacrylate as a matting agent (mean particle size: 3.0 microns), N,N'-ethylenebis(-vinylsulfonylacetamide) as a hardener, and water solutions of the nonionic and ionic surface active agents of the present invention, and optionally a fluorine-containing surface active agent, as set forth in Table 4.

(3) Preparation of Coating Composition for Backing Layer

A coating composition was prepared in the same manner as disclosed in paragraph (5) of Example 1.

(4) Preparation of Coating Composition for Outermost Layer on the Side of Backing Layer To a 10 wt % of aqueous gelatin solution heated to 40° C. were added an aqueous solution of sodium polystyrenesulfonate as a viscosity increasing agent, polymethylmethacrylate fine particles (mean particle size: 4.2 microns) as a matting agent, an aqueous solution of sodium t-octylphenoxyethoxyethoxyethanesulfonate as a coating aid, and an aqueous solution of the surface active agent of polyethylene type (polyoxyethylene cetyl ether) and the fluorine-containing compounds of the following chemical structures as an antistatic agent to prepare a coating composition.

$C_8F_{17}SO_3K$ and $C_8F_{17}SO_2N(C_3H_7)(CH_2CH_2O)_{15}H$ (5) Preparation of Coated Sample On one side of a polyethylene terephthalate film support was coated the foregoing coating composition for a backing layer together with the foregoing coating composition for the outermost layer on the backing layer side at a coverage of 4 $g/m^2$ on a gelatin basis. Subsequently, the coating composition for the emulsion described in (2) in which an infrared sensitizing dye was incorporated, and the coating composition for the outermost layer on the emulsion layer side were coated on the other side of the support at a coverage of 3.5 $g/m^2$ on a silver basis.

The thus-obtained sample films were examined for contact effects upon photographic properties, static marks from urethane rollers used in a laser scanner part and an automatic developing machine part, the facility in traveling on a stainless steel part by a mechanical device, and development marks using the methods described below, respectively.

The developer and the fixer used had the following compositions, respectively.

| Composition of Developer: | |
|---|---|
| Potassium Hydroxide | 17 g |
| Sodium Sulfite | 60 g |
| Diethylenetriaminetetraacetic Acid | 2 g |
| Potassium Carbonate | 5 g |
| Boric Acid | 3 g |
| Hydroquinone | 25 g |
| Diethylene Glycol | 12 g |
| 4-Hydroxymethyl-4-methyl-1-phenyl-3-pyrazolidone | 16.5 g |

-continued

| | |
|---|---|
| 5-Methylbenzotriazole | 0.6 g |
| Acetic Acid | 1.8 g |
| Potassium Bromide | 2 g |
| Water to make | 1 liter |
| pH adjusted to | 10.35 |
| Composition of Fixer: | |
| Ammonium Thiosulfate | 140 g |
| Sodium Sulfite | 15 g |
| Disodium Ethylenediaminetetraacetate Dihydrate | 25 mg |
| Sodium Hydroxide | 6 g |
| Water to make | 1 liter |
| Acetic acid to adjust pH to | 4.95 |

The photographic processing comprised the following steps.

| Step | Temperature (°C.) | Time (sec) |
|---|---|---|
| Development | 35 | 11.5 |
| Fixation | 35 | 12.5 |
| Washing | 20 | 7.5 |
| Drying | 60 | |

The dry to dry processing time spent in this photographic processing was 60 seconds.

(6) Evaluation of Static Marks

Each sample film was evaluated in the same manner as disclosed in paragraph (3) of Example 2.

(7) Evaluation Method of Contact Influences upon Photographic Quality

Each sample film was evaluated in the same manner as disclosed in paragraph (6)(a) of Example 1.

(8) Evaluation Method of Facility in Machine Traveling

A sample film measuring 12 cm×30 cm in size was allowed to stand for 3 hours under the condition of 25° C., 10% RH in order to control the humidity of the film. Under the same temperature and humidity, the film was passed between two rollers of urethane rubber (diameter: 3 cm), and then allowed to fall naturally over a stainless steel plate inclined at an angle of 45° to the horizontal plane in such a condition that the backing layer side might face on the stainless steel plate. Adhesion condition of the sample film to the smooth stainless steel plate (130 cm×90 cm) was evaluated classifying into the following four ranks.

A: No adhesion to the stainless steel was observed, and the film fell smoothly.

B: Weak adhesion to the stainless steel was observed, and it took the film a little time to fall.

C: Adhesion to the stainless steel was observed, and it took the film much time to fall.

D: The film stuck to the stainless steel and did not fall.

(9) Evaluation Method of Development Marks

Each sample film was evaluated in the same manner as disclosed in paragraph (7) of Example 1.

TABLE 4

| Sample No. | Outermost Layer on Emulsion Layer Side: Nonionic Surface Active Agent (mg/m²) | Ionic Surface Active Agent (mg/m²) | Fluorine-Containing Surface Active Agent (mg/m²) | Ionic Surface Active Agent: Solubiltiy in Developer | Surface Tension in 1.0 wt % aq. soln. (dyne/cm) | Contact Influence on Photographic Quality | Static Marks | Facility in Machine Traveling | Development Marks |
|---|---|---|---|---|---|---|---|---|---|
| 4-1 (Control) | — | — | — | — | 72 | A | D | D | C |
| 4-2 (Invention) | III-6 (35) | II-4 (15) | — | 0.005% or more | 27 | A | B | A | A |
| 4-3 (Invention) | III-6 (35) | II-3 (20) | — | " | 28 | A | A | A | A |
| 4-4 (Invention) | III-6 (40) | II-6 (20) | — | " | 30 | A | A | A | A |
| 4-5 (Invention) | III-12 (40) | II-4 (10) | — | " | 27 | B | B | A | A |
| 4-6 (Invention) | III-12 (50) | II-7 (15) | — | " | 31 | B | A | A | A |
| 4-7 (Invention) | III-27 (30) | II-10 (18) | — | " | 29 | A | B | A | A |
| 4-8 (Invention) | III-31 (37) | II-4 (20) | — | " | 27 | B | A | A | A |
| 4-9 (Invention) | III-12 (40) | II-11 (20) | IV-1 (6) | " | 30 | A | A | A | A |
| 4-10 (Invention) | III-6 (40) | II-23 (15) | IV-7 (2) | " | 34 | A | A | A | A |
| 4-11 (Invention) | III-31 (35) | II-10 (16) | IV-8 (5) | " | 29 | A | A | A | A |
| 4-12 (Invention) | III-13 (35) | II-1 (30) | IV-21 (5) | " | 33 | A | A | A | A |
| 4-13 (Comparison) | III-6 (35) | — | — | — | — | A | B | A | D |
| 4-14 (Comparison) | III-31 (35) | — | — | — | — | A | B | B | D |
| 4-15 (Comparison) | III-6 (35) | (a)* (20) | — | 0.005% or less | 27 | A | B | A | D |
| 4-16 (Comparison) | II-6 (45) | (b)* (20) | — | " | 28 | A | A | A | D |

*Comparative compounds.

(a): $NaO_3S-CH(CH_2COOC_8H_{17})-COOC_8H_{17}$ (b): 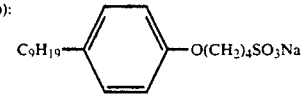

As can be seen from the results shown in Table 4, the samples (Sample Nos. 4-2 to 4-12), in which both nonionic and ionic surface active agents of the present invention were contained, acquired not only such an excellent antistatic effect that generation of static marks could not be observed even under the low humidity condition of 10% RH, but also satisfactory properties in respects of the contact influence on photographic quality and the facility in machine traveling. In addition, generation of development marks was not observed therein at all. In contrast to the samples of the invention, the control sample was considerably inferior in antistatic capacity and facility in machine traveling, and further generated development marks. On the other hand, Comparative Sample Nos. 4-13 and 4-14, in which no nonionic surface active agent was used, generated development marks to a considerable extent, and Comparative Sample Nos. 4-15 and 4-16, in which ionic surface active agents having a solubility of 0.005 wt % or less were contained, were much inferior to the samples of the present invention in respect that development marks were observed to a marked extent.

Each sample film of the present invention was wedgewise exposed by means of a semiconductor laser scanner having a wavelength of 780 nm, subjected to development and fixation in the above-described manner, and further washed with water to obtain strips with an intended black-and-white image.

The images thus obtained were excellent in sensitivity and gradation, and had low fog density.

While the invention has been described in detail and with reference to specific embodiments thereof, it will be apparent to one skilled in the art that various changes and modifications can be made therein without departing from the spirit and scope thereof.

What is claimed is:

1. A method of forming an image comprising exposing, developing, and fixing a laser scanner-utilizable silver halide photographic material which has at least one silver halide emulsion layer sensitized spectrally in an infrared region on one side of a support, wherein the photographic material contains in at least one layer located on the emulsion side an ionic surface active agent having a solubility of 0.005 wt % or more at 30° C. in a developer and a surface tension of 45 dyne/cm or less (measured at 30° C. in a 1.0 wt % aqueous solution), and wherein the photographic material further contains one or more additives selected from the group consisting of (i) non-ionic surface active agents, and (ii) polymers represented by the following general formula (I) and having a molecular weight of from 2,000 to 500,000:

$$-(-X-)_x(-Y-)_y$$

wherein X represents a residue of an acrylamide monomer, and Y represents a residue of a monomer other than X, which can undergo copolymerization with X, and these monomers each may be a mixture of two or more thereof; x represents a fraction of 70 to 10 mol %, and y represents a fraction of 30 to 0 mol %, and further provided that the photographic material is capable of developing within 15 seconds.

2. The method of claim 1, wherein the polymer of formula (I) is contained in an amount of from 4 to 300 wt % of a binder contained in the outermost layer.

3. The method of claim 1, wherein the recording light source is a semiconductor laser.

4. The method of claim 1, wherein the ionic surface active agent contains a hydrophobic group selected from the group consisting of a substituted or unsubstituted alkyl, alkenyl, aralkyl or aryl group having not less than 4 carbon atoms and a hydrophilic group selected from the group consisting of an anion, a cation, and a betaine group.

5. The method of claim 3, wherein the hydrophobic group is selected from the group consisting of substituted alkyl, alkenyl, aralkyl and aryl groups containing 60 to 40 carbon atoms.

6. The method of claim 4, wherein the hydrophobic groups are selected from the group consisting of hexyl, octyl, nonyl, decyl, dodecyl, cetyl, stearyl, oleyl, nonylphenyl, octylphenyl, di-t-amylphenyl, di-nonylphenyl, dodecylphenyl, dodecylbiphenyl, bis(di-t-butylphenyl)methylene, bis(di-t-butylphenyl)phenylmethylene, perfluorooctyl, perfluorodecyl, perfluorohexyl, perfluorononyl, and perfluorododecyl groups.

7. The method of claim 4, wherein the anionic group is selected from the group consisting of carboxylates, sulfonates, phosphates, sulfates, and borates, the cationic group is selected from the group consisting of tertiary amines, quaternary amines, phosphonium and sulfonium, and the betaine group is selected from the group consisting of amino acids, carboxy betaines, sulfoxy betaines and phospho betaines.

8. The method of claim 4, wherein the hydrophilic groups are selected from carboxylates, sulfonates, phosphates, sulfates, tertiary or quaternary amines, carboxy betaines, and sulfo betaines.

9. The method of claim 2, wherein X is selected from the group consisting of acrylamide, methacrylamide, N-alkylacrylamide, and N-alkylmethacrylamide.

10. The method of claim 2, wherein Y is selected from the group consisting of vinyl alcohol, acrylic acid, methacrylic acid, maleic acid, itaconic acid, maleic anhydride, carboxystyrene, sulfostyrene, vinylsulfonic acid, $-CONHC(CH_3)_2CH_2SO_3H$ and salts thereof, vinylpyrrolidone, vinyloxazolidine, acrylic acid esters, methacrylic acid esters, itaconic acid esters, styrene, maleic acid esters, acrylonitrile, and methacrylonitrile.

11. The method of claim 2, wherein Y represents methacrylate, ethyl acrylate, hydroxyethyl acrylate, methyl methacrylate, ethyl methacrylate, hydroxyethyl methacrylate, methyl itaconate, ethyl itaconate, hydroxyethyl itaconate, monomethyl maleate, dimethyl maleate, monoethyl maleate, diethyl maleate and monohydroxyethyl maleate.

12. The method of claim 2, wherein said polymers have a molecular weight of from 4,000 to 100,000.

13. The method of claim 2, wherein said polymer is added to the outermost layer in a proportion of from 7.5 to 150 wt % based on the weight of binders contained in the outermost layer.

14. The method of claim 1, wherein the dry-to-dry processing time is within 60 seconds.

15. The method of claim 1, wherein the photographic material further contains in at least one layer located on the emulsion side a non-ionic surfactant represented by general formulae (III-A), (III-B), or (III-C):

$$R_1-A-(B)_{n1}R \qquad \text{(III-A)}$$

(III-B)

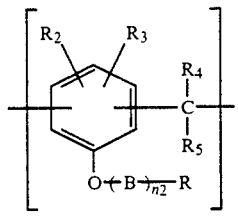

(III-C)

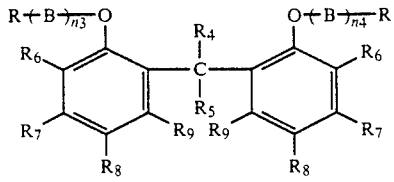

wherein R represents a hydrogen atom, an alkyl group having 1 to 4 carbon atoms, or an alkylcarbonyl group having 1 to 5 carbon atoms; $R_1$ represents a substituted or unsubstituted alkyl, alkenyl or aryl group having 1 to 30 carbon atoms; A represent an —O—, —S—, —COO—, $$-\underset{|}{N}-R_{10},\quad -CO-\underset{|}{N}-R_{10}\quad \text{or}\quad -SO_2-\underset{|}{N}-R_{10}$$

group (wherein $R_{10}$ represents a hydrogen atom, or a substituted or unsubstituted alkyl group); B represents a hydroxyalkylene group; $R_2$, $R_3$, $R_7$ and $R_9$ each represents a hydrogen atom, a substituted or unsubstituted alkyl group, an aryl group, an alkoxy group, an aryloxy group, a halogen atom, an acyl group, an amido group, a sulfonamido group, a carbamoyl group or a sulfamoyl group; $R_6$ and $R_8$ represent a substituted or unsubstituted alkyl group, an aryl group, an alkoxy group, an aryloxy group, a halogen atom, an acyl group, an amido group, a sulfonamido group, a carbamoyl group, or a sulfamoyl group; and in the general formula (III-3), the substituent groups of the phenyl ring may be asymmetrical on right and left sides; $R_4$ and $R_5$ each represents a hydrogen atom, a substituted or unsubstituted alkyl group, or an aryl group; $R_4$ and $R_5$, $R_6$ and $R_7$, and $R_8$ and $R_9$ may combine with each other to form a substituted or unsubstituted ring; and $n_1$, $n_2$, $n_3$ and $n_4$ each represents a mean polymerization degree of an oxyalkylene group, and ranging from 2 to 50.

* * * * *